US012656045B2

(12) United States Patent
Leidens et al.

(10) Patent No.: US 12,656,045 B2
(45) Date of Patent: Jun. 16, 2026

(54) DOOR WARMER FOR A REFRIGERATOR

(71) Applicant: Electrolux Do Brasil S.A., Curitiba (BR)

(72) Inventors: Rafael Leidens, Curitiba (BR); Israel Mercer, Curitiba (BR); Antonio Voltarelli, Curitiba (BR); Alcione Colecha, Curitiba (BR); Guilherme Picanço, Curitiba (BR)

(73) Assignee: Electrolux Do Brasil S.A., Curitiba (BR)

( * ) Notice: Subject to any disclaimer, the term of this patent is extended or adjusted under 35 U.S.C. 154(b) by 84 days.

(21) Appl. No.: 18/795,682

(22) Filed: Aug. 6, 2024

(65) Prior Publication Data

US 2024/0393032 A1 Nov. 28, 2024

Related U.S. Application Data

(62) Division of application No. 16/971,902, filed as application No. PCT/BR2018/050050 on Mar. 2, 2018, now Pat. No. 12,078,404.

(51) Int. Cl.
*F25D 21/04* (2006.01)
*F25D 11/02* (2006.01)

(52) U.S. Cl.
CPC ..... *F25D 21/04* (2013.01); *F25D 11/02* (2013.01); *F25D 2600/04* (2013.01)

(58) Field of Classification Search
CPC ..... F25D 21/04; F25D 23/066; F25D 2321/1412; F25D 2600/04
See application file for complete search history.

(56) References Cited

U.S. PATENT DOCUMENTS 2,811,406 A 10/1957 Moore et al.
3,116,615 A 1/1964 Harle
(Continued)

FOREIGN PATENT DOCUMENTS

CN 109708359 5/2019
JP S57108068 7/1982
(Continued)

OTHER PUBLICATIONS

International Search Report and Written Opinion for International Application No. PCT/BR2018/050050, dated Apr. 15, 2019, 17 pages.

(Continued)

*Primary Examiner* — Daniel J Rohrhoff
(74) *Attorney, Agent, or Firm* — Chrisman Gallo Tochtrop LLC

(57) ABSTRACT

A door warmer for a refrigerator includes a liner defining a compartment. The liner includes a front face circumscribing the compartment, a flange extending outwards from the front face, and a recessed pocket formed into the flange. An inner retention lug is positioned adjacent to, and extends a first distance over, the recessed pocket. An outer retention lug is positioned adjacent to, and extends a second distance over, the recessed pocket and located on a side of the recessed pocket opposite from the inner retention lug. A heat pipe is disposed within the recessed pocket and secured therein by the inner and outer retention lugs.

10 Claims, 14 Drawing Sheets

(56) References Cited

U.S. PATENT DOCUMENTS 4,114,065 A * 9/1978 Horvay ..... F25D 23/061 62/298
4,920,765 A 5/1990 McCauley et al.
5,366,283 A 11/1994 Crose
5,369,963 A 12/1994 Pickles et al.
5,819,552 A 10/1998 Lee
6,178,763 B1 * 1/2001 Brancheau ..... F25D 23/085 219/536
6,393,855 B1 * 5/2002 Schuchert ..... F25D 23/061 62/277
7,008,032 B2 3/2006 Chekal et al.
7,051,539 B2 5/2006 Junge et al.
7,089,755 B2 8/2006 Schmid et al.
7,107,785 B2 9/2006 Barmann et al.
7,231,780 B2 6/2007 Park
7,284,390 B2 10/2007 Meter et al.
7,287,397 B2 10/2007 Coulter et al.
7,299,651 B2 11/2007 Oh
7,337,620 B2 3/2008 Coulter et al.
7,458,229 B2 12/2008 Van Meter et al.
7,549,297 B2 6/2009 Martin et al.
7,552,594 B2 6/2009 Coulter et al.
7,559,211 B2 7/2009 Revlett et al.
7,568,354 B2 8/2009 Coulter et al.
7,568,357 B2 8/2009 Jenkins, Jr. et al.
7,568,359 B2 8/2009 Wetekamp et al.
7,591,141 B2 9/2009 Wetekamp et al.
7,594,413 B2 9/2009 Martin et al.
7,607,312 B2 10/2009 Wetekamp et al.
7,610,774 B2 11/2009 Anderson et al.
7,659,491 B2 2/2010 Yang
7,726,148 B2 6/2010 Martin et al.
7,762,100 B2 7/2010 Bae et al.
7,866,182 B2 1/2011 Lim et al.
7,870,754 B2 1/2011 Martin et al.
7,891,198 B2 2/2011 Wetekamp et al.
7,900,465 B2 3/2011 Wetekamp et al.
8,028,534 B2 10/2011 Jenkins, Jr. et al.
8,117,863 B2 2/2012 Van Meter et al.
8,196,427 B2 6/2012 Bae et al.
8,434,317 B2 5/2013 Besore
D694,296 S 11/2013 Coulter et al.
D694,297 S 11/2013 Coulter et al.
8,590,992 B2 11/2013 Lim
8,616,019 B2 12/2013 Van Meter et al.
D697,094 S 1/2014 Coulter et al.
8,695,370 B2 4/2014 Coulter et al.
8,794,024 B2 8/2014 Martin et al.
8,806,885 B2 8/2014 Bae et al.
D712,440 S 9/2014 Coulter et al.
8,864,251 B2 10/2014 Kuehl et al.
8,926,032 B2 1/2015 Kuehl et al.
8,960,824 B2 2/2015 Wilcox et al.
9,080,808 B2 7/2015 Choi et al.
9,097,455 B2 8/2015 Coulter et al.
9,157,676 B2 10/2015 Lee et al.
9,163,870 B2 10/2015 Jeon et al.
9,188,382 B2 11/2015 Kim et al.
9,200,827 B2 12/2015 Coulter et al.
9,207,008 B2 12/2015 Martin et al.
9,207,009 B2 12/2015 Coulter et al.
9,222,716 B2 12/2015 Coulter et al.
9,222,717 B2 12/2015 Coulter et al.
9,222,718 B2 12/2015 Coulter et al.
9,250,004 B2 2/2016 Coulter et al.
9,250,007 B2 2/2016 Kuehl et al.
9,255,728 B2 2/2016 Coulter et al.
9,267,724 B2 2/2016 Coulter et al.
9,285,151 B2 3/2016 Coulter et al.
9,291,383 B2 3/2016 Besore
9,322,474 B2 4/2016 Lee et al.
9,395,114 B2 7/2016 Martin et al.
9,404,682 B2 8/2016 Coulter et al.
9,447,999 B2 9/2016 Coulter et al.
9,476,627 B2 10/2016 Coulter et al.
9,599,393 B2 3/2017 Jeon et al.
9,970,701 B2 * 5/2018 Cho ..... F25D 21/04
10,451,339 B1 10/2019 Wantland
11,703,273 B1 7/2023 Karl
2008/0104977 A1 5/2008 Coulter et al.
2008/0196441 A1 8/2008 Ferreira et al.
2008/0276540 A1 11/2008 Kim
2010/0125365 A1 5/2010 Ahn et al.
2010/0126207 A1 5/2010 Bae et al.
2010/0326102 A1 12/2010 Wetekamp et al.
2011/0000237 A1 1/2011 Wetekamp et al.
2011/0000238 A1 1/2011 Wetekamp et al.
2011/0011106 A1 1/2011 Ahn et al.
2011/0011118 A1 1/2011 Cho et al.
2012/0006829 A1 1/2012 Jenkins, Jr. et al.
2012/0096887 A1 4/2012 Cho et al.
2012/0313497 A1 * 12/2012 Jang ..... F25D 23/069 312/401
2013/0099651 A1 4/2013 Hwang et al.
2013/0199214 A1 8/2013 Coulter et al.
2013/0205825 A1 8/2013 Coulter et al.
2014/0060106 A1 3/2014 Van Meter et al.
2014/0097733 A1 4/2014 Seo et al.
2014/0152166 A1 6/2014 Baum
2014/0157805 A1 * 6/2014 Kwon ..... F25D 21/04 62/176.1
2014/0265802 A1 9/2014 Wilcox et al.
2014/0312759 A1 10/2014 Song
2015/0069066 A1 3/2015 Choi et al.
2015/0192347 A1 7/2015 Cho et al.
2016/0040923 A1 2/2016 Kim et al.
2016/0084557 A1 3/2016 Coulter et al.
2016/0084570 A1 3/2016 Coulter et al.
2016/0146528 A1 5/2016 Yoon et al.
2016/0178267 A1 6/2016 Hao et al.
2016/0282029 A1 9/2016 Martin et al.
2016/0282037 A1 9/2016 Han et al.
2016/0290702 A1 10/2016 Sexton et al.
2016/0370105 A1 12/2016 Park et al.
2019/0357679 A1 11/2019 Li
2020/0196754 A1 6/2020 Wang
2020/0232701 A1 7/2020 Li
2021/0341215 A1 11/2021 Kang
2021/0341218 A1 11/2021 Wei
2022/0034579 A1 2/2022 Park
2024/0159447 A1 * 5/2024 Lim ..... F25D 21/04

FOREIGN PATENT DOCUMENTS

JP 2013002702 1/2013
JP 2014211181 11/2014
JP 2014222134 A 11/2014
JP 2015014373 A 1/2015
KR 100656395 B1 12/2006
KR 20150062662 6/2015
WO 2012067417 A2 5/2012

OTHER PUBLICATIONS

Extended European Search Report for 18907488.3, dated Feb. 2, 2022, 139 pages.

* cited by examiner

DOOR WARMER FOR A REFRIGERATOR

CROSS-REFERENCE TO RELATED APPLICATIONS

This application is a division of U.S. patent application Ser. No. 16/971,902 filed on Aug. 21, 2020, which is a U.S. National Phase Application of PCT International Application No. PCT/BR2018/050050 filed on Mar. 2, 2018. The contents of these applications are incorporated herein by reference in their entireties.

FIELD OF THE INVENTION

This application relates generally to a door warmer for a refrigeration appliance, and more particularly, to a refrigeration appliance including a heat pipe disposed within a recessed pocket formed into a front face circumscribing a compartment. The application also relates generally to a drawer for a refrigeration appliance, and more particularly, to moveable divider for the drawer.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Generally, when a user interacts with a drawer that selectively permits access to the freezer compartment, condensation will form at an interfacing region between the drawer and a liner of the freezer compartment. To reduce the amount of condensation, or to even prevent this phenomena from occurring, some refrigerators include a heating system secured about the interface between the door/drawer and the refrigerator cabinet, such as about an outer face of the liner. Specifically, such systems generally include tubes and/or electric resistive members disposed about the outer perimeter of the face of the liner.

In order to secure the heater/tubes to the liner, individual attachment means (e.g., clips, fasteners, adhesives, etc.) are used. Of note, these attachment means increase the cost and overall complexity of the assembly process. Specifically, adding subsequent elements to attach the heater/tube to the outer face of the liner not only increases the cost of the overall refrigerator (i.e., the additional cost per attachment part), but also the cost associated with set-up and change out operations with respect to manufacturing processes.

In one aspect, the present invention provides a recessed pocket formed into a flange extending along a front face of a refrigerator liner, wherein a heater/tube is disposed within the recessed pocket and secured therein by inner and outer retention lugs that are arranged on the flange in a staggered formation. Due to this configuration, additional attachment means are no longer required and thus overall complexity of manufacturing/assembly is reduced.

In addition or alternatively, when a user interacts with a drawer that selectively permits access to the freezer compartment or a refrigerated compartment, a basket is used to provide a convenient storage space for storing food. However, when a large amount of food is stored in the basket, it can be difficult to find particular items and/or organize the food.

In another aspect, the present invention provides a divider disposed within the storage space for dividing the storage space into at least two storage areas to enable a user to better organize the food. The divider further includes a pair of carriages that ride along a pair of tracks formed lengthwise into the front and rear walls of the basket body. The pair of carriages engage with and travel along the pair of tracks to enable lateral movement of the divider within the storage space of the basket so that the user can selectively increase and/or decrease the relative sizes of the at least two storage areas.

BRIEF SUMMARY OF THE INVENTION

In accordance with one aspect, there is provided a refrigerator including a cabinet wherein a liner defines a compartment within the cabinet. The liner includes a front face circumscribing an access opening of said compartment. A flange extends outwards from the front face in a direction parallel to the front face and away from the access opening, the flange extends about a perimeter of the front face. A recessed pocket is formed into the flange along an extended portion of the front face. The liner further includes at least one inner retention lug positioned adjacent to, and extending a first distance over, the recessed pocket and located on a side of the recessed pocket closest to the front face, and at least one outer retention lug positioned adjacent to, and extending a second distance over, the recessed pocket and located on a side of the recessed pocket opposite from the inner retention lug. The refrigerator further includes a heat pipe disposed within the recessed pocket and secured therein by the inner and outer retention lugs. The heat pipe is configured to reduce and/or eliminate the formation of condensation around the front face of the liner.

The refrigerator according to the foregoing aspect further comprising a first partition that separates the compartment into a fresh food section and a freezer section. The heat pipe is only disposed within a portion of the recessed pocket that is formed into the flange that extends outwards from the front face only about the freezer section. The refrigerator also includes a second partition that separates the freezer section into a first zone and a second zone.

The heat pipe in the foregoing refrigerator is a condenser tube of an evaporative cooling system. The condenser tube includes first and second ends, wherein the first end of the condenser tube is connected to a discharge port of said evaporative cooling system and wherein the second end of the condenser tube is connected to an inlet port of said evaporative cooling system.

In the refrigerator, the front face of the freezer section comprises a first side segment, a second side segment, and a bottom segment. The first and second side segments are parallel and are both perpendicular to the bottom segment. Further the recessed pocket is formed into the flange extending outwards from the first side segment, the second side segment, and the bottom segment.

The condenser tube of the foregoing refrigerator comprises a first portion extending vertically along the first side segment of the front face, a second portion extending horizontally along the bottom segment of the front face, and a third portion extending vertically along the second side segment of the front face between the bottom segment of the front face and the second partition. The condenser tube further includes a first loop portion extending horizontally along the second partition between the first and second side segments of the front face, a fourth portion extending vertically along the second side segment of the front face between the second partition and the first partition, and a second loop portion extending horizontally along the first partition between the first and second side segments of the front face.

In the foregoing refrigerator, a plurality of inner retention lugs are equally spaced and disposed along the first and second side segments and the bottom segment of the front face. Further, a plurality of outer retention lugs are equally spaced and disposed along the first and second side segments and the bottom segment of the front face.

In the aforementioned refrigerator, the inner retention lug is arranged on the flange in a staggered formation with respect to the outer retention lug. Further, the inner retention lug has a first length spanning between a first forward end and a first rearward end, and the outer retention lug has a second length spanning between a second forward end and a second rearward end. Further still, the staggered formation is defined by the inner and outer retention lugs being positioned about the recessed pocket such that the first forward end of the inner retention lug is disposed adjacent the second rearward end of the outer retention lug, without said inner and outer retention lugs overlapping.

In the foregoing refrigerator, the liner, front face, flange, recessed pocket, and inner and outer retention lugs are all formed integral into a single piece.

The heat pipe in the foregoing refrigerator is secured within the recessed pocket only by the inner and outer retention lugs.

The flange in the foregoing refrigerator is configured such that the inner and outer retention lugs secure the heat pipe within the recessed pocket such that the heat pipe does on protrude beyond an imaginary plane upon which the front face lies.

In the foregoing refrigerator, the flange is configured such that the inner and outer retention lugs secure the heat pipe within the recessed pocket such that the inner and outer retention lugs do not protrude beyond an imaginary plane upon which the front face lies.

In accordance with another aspect, there is provided a drawer assembly for a refrigerator appliance. The refrigerator includes a cooled compartment comprising opposed, first and second interior walls and a basket that moves relative to the cooled compartment. The basket includes a body having a storage space therein for storing food. The storage space is defined by a front wall, a rear wall, opposing side walls, and a bottom. The opposing side walls are adjacent to the first and second interior walls of the cooled compartment. The basket further includes a par of slots formed lengthwise into the front and rear walls of the body, respectively. The pair of slots define a pair of tracks, respectively, which extend outwards away from the storage space in a lateral direction with respect to the front and rear walls. Further still, the basket includes a divider disposed within the storage space for dividing the storage space into at least two storage areas. The divider comprises a main surface positioned perpendicular to and extending between the front and rear walls, and a pair of ends, wherein the divider further includes a pair of carriages and wherein one carriage of the pair of carriages is secured to each end of the pair of ends. Further, the pair of carriages are positioned within the pair of slots, respectively, and said pair of carriages engage with and travel along the pair of tracks so as to promote movement of the divider within the storage space to thereby selectively increase and/or decrease the relative sizes of the at least two storage areas.

The foregoing drawer assembly further includes a pair of caps that are secured to the pair of tracks, respectively, so as to enclose the pair of slots from outside of the body. The pair of slots are apertures formed into and extending completely through the front and rear walls, respectively.

In the foregoing drawer assembly, each carriage of the pair of carriages includes at least one wheel. The wheel engages the track.

The divider in the foregoing drawer assembly includes a first side portion and a second side portion. The first and second side portions are perpendicular to the main surface and extend along a direction being parallel to the front and rear walls, respectively.

In the foregoing drawer assembly, bearings are disposed on each of the first and second side portions of the divider and engage with an interior surface of the front and rear walls, respectively.

The divider in the foregoing drawer assembly further includes a first divider member and a second divider member that are separable from one another such that, in a separated state, the storage space is divided into three storage areas.

In accordance with yet another aspect, there is provided a refrigerator including a cabinet and a liner defining a compartment within the cabinet. The liner includes a rear wall, first and second opposing side walls, and a top wall. An air tower is positioned adjacent the rear wall of the liner and provided in fluid communication with the compartment via a plurality of exhaust openings. The air tower includes a front surface and an opposing rear surface, at least one reception opening, and an extension member. The extension member extends outward away from the rear surface of the air tower and circumscribes the reception opening. First and second clips are positioned at opposing longitudinal sides of the extension member. The refrigerator further includes a rail secured to the rear wall of the liner, the rail includes a side surface, a front face, and a flange member that extends rearwards away from the front face. In an installed position, the rail is positioned between the longitudinal sides of the extension member and is removably attached thereto such that the first clip is disposed within a securing opening positioned on the side surface of the rail, and the second clip engages with the flange member of the rail.

The first and second clips in the foregoing refrigerator are arranged on the opposing longitudinal sides of the extension member such that the first and second clips are horizontally aligned.

The foregoing refrigerator wherein a plurality of first clips and a plurality of second clips are positioned at opposing longitudinal sides of the extension member and are arranged such that each first clip and each respective second clip are horizontally aligned.

In the foregoing refrigerator, the front face of the rail includes a plurality of openings configured to accept legs of a shelf therein.

In accordance with yet another aspect, there is provided a refrigerator including a cabinet, a liner defining a compartment within the cabinet, a first door pivotally coupled to the cabinet at a first side, and a second door pivotally coupled to the cabinet at a second side. The second side of the cabinet is opposite the first side of the cabinet. Further, the first and second doors collectively span a lateral distance between the first and second sides such that the first and second doors permit selective access to the compartment. The refrigerator also includes a center flip mullion assembly positioned on one of the first door and the second door. The center flip mullion assembly includes a base member having a bottom wall and first and second opposing side walls that extend, in a perpendicular direction, away from the bottom wall. A body member is inserted within the base member and positioned between the first and second opposing side walls. The body member includes a reception area defined between opposing first and second protrusions which extend outwards and away from a front face of the body member. A cap is positioned over the body member such that the cap extends between the first and second opposing side walls and covers the reception area. The cap has a front surface and a rear surface. An adhesive is disposed on a portion of the rear surface of the cap. Further still, a heater tube is positioned within the reception area and attached to the adhesive.

The cap in the foregoing refrigerator includes a raised portion. A first gap is defined between the first opposing side wall and the raised portion, and a second gap is defined between the second opposing side wall and the raised portion.

In the foregoing refrigerator, first and second gaskets are positioned in the first and second gaps, respectively.

DESCRIPTION OF EXAMPLE EMBODIMENTS

Figure 1:
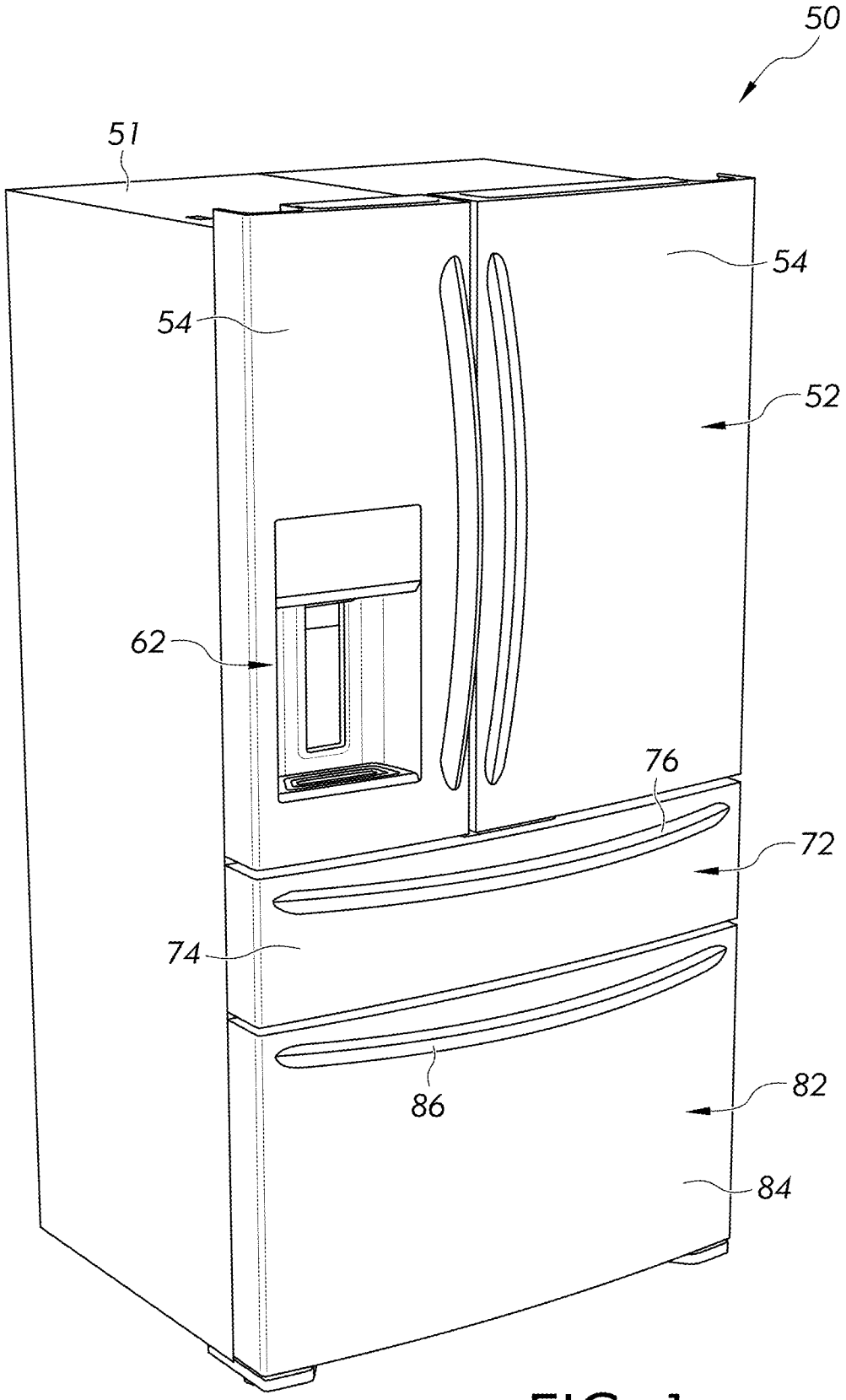
FIG. 1 is a front perspective view of a household French Door Bottom Mount refrigerator showing doors of the refrigerator in a closed position.

Referring now to the drawings, FIG. 1 shows a refrigeration appliance in the form of a domestic refrigerator, indicated generally at 50. Although the detailed description that follows concerns a domestic refrigerator 50, the invention can be embodied by refrigeration appliances other than with a domestic refrigerator 50. Further, an embodiment is described in detail below, and shown in the figures as a bottom-mount configuration of a refrigerator 50, including a fresh food compartment 52 disposed vertically above a variable climate zone (VCZ) compartment 72 and a freezer compartment 82.

Two doors 54 shown in FIG. 1 are pivotally coupled to a cabinet 51 of the refrigerator 50 to restrict and grant access to the fresh food compartment 52. The doors 54 are French-type doors that collectively span the entire lateral distance of the entrance to the fresh food compartment 52 to enclose the fresh food compartment 52. A center flip mullion 58 (FIG. 2) is pivotally coupled to at least one of the doors 54 to establish a surface against which a seal provided to the other one of the doors 54 can seal the entrance to the fresh food compartment 52 at a location between opposing side surfaces 59 (FIG. 2) of the doors 54. The mullion 58 can be pivotally coupled to the door 54 to pivot between a first orientation that is substantially parallel to a planar surface of the door 54 when the door 54 is closed, and a different orientation when the door 54 is opened. The externally-exposed surface of the center mullion 58 is substantially parallel to the door 54 when the center mullion 58 is in the first orientation, and forms an angle other than parallel relative to the door 54 when the center mullion 58 is in the second orientation. In the embodiment shown in FIG. 1, the seal and the externally-exposed surface of the mullion 58 cooperate at a position offset from a centerline midway between the lateral sides of the fresh food compartment 52. It is contemplated that the seal and the externally-exposed surface of the mullion 58 can cooperate approximately midway between the lateral sides of the fresh food compartment 52.

A dispenser 62 (FIG. 1) for dispensing at least ice pieces, and optionally water, can be provided on an exterior of one of the doors 54 that restricts access to the fresh food compartment 52. The dispenser 62 includes a lever, switch, proximity sensor or other device that a user can interact with to cause frozen ice pieces to be dispensed from an ice bin (not shown) of an ice maker 64 disposed within the fresh food compartment 52. Ice pieces from the ice maker 64 can exit the ice maker 64 through an aperture (not shown) and be delivered to the dispenser 62 via an ice chute (not shown), which extends at least partially through the door 54 between the dispenser 62 and the ice maker.

The refrigerator 50 includes an interior liner 53 (FIG. 2) that defines the fresh food compartment 52. The fresh food compartment 52 is located in the upper portion of the refrigerator 50 in this example and serves to minimize spoiling of articles of food stored therein. The fresh food compartment 52 accomplishes this by maintaining the temperature in the fresh food compartment 52 at a cool temperature that is typically above 0° C., so as not to freeze the articles of food in the fresh food compartment 52. It is contemplated that the cool temperature preferably is between 0° C. and 10° C., more preferably between 0° C. and 5° C. and even more preferably between 0.25° C. and 4.5° C. A separate fresh food evaporator (not shown) is dedicated to separately maintaining the temperature within the fresh food compartment 52 independent of the freezer compartment 82. According to an embodiment, the temperature in the fresh food compartment 52 can be maintained at a cool temperature within a close tolerance of a range between 0° C. and 4.5° C., including any subranges and any individual temperatures falling with that range. For example, other embodiments can optionally maintain the cool temperature within the fresh food compartment 52 within a reasonably close tolerance of a temperature between 0.25° C. and 4° C.

Figure 2:
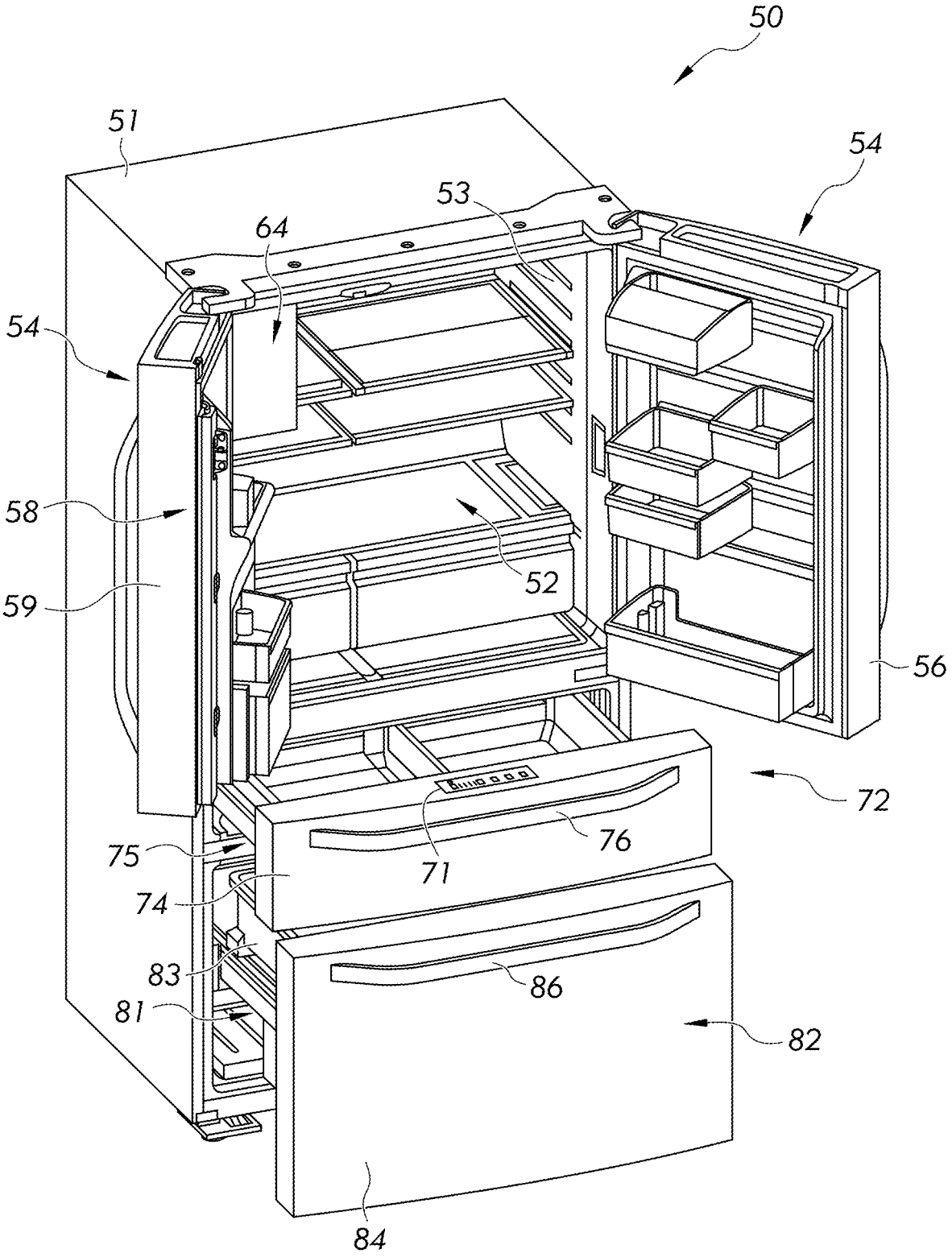
FIG. 2 is a front perspective view of the refrigerator of FIG. 1 showing doors of a fresh food compartment and drawers of a freezer compartment and a variable climate zone compartment in an opened position.

Referring to FIG. 2, the VCZ compartment 72 is arranged vertically beneath the fresh food compartment 52. The VCZ compartment 72 can operate at different user-selectable temperatures as either a refrigerator (i.e., above-freezing) or a freezer (i.e., below-freezing). A control unit or user interface 71 is disposed on a front panel 74 of the VCZ compartment 72 to allow a user the ability to selectively operate the VCZ compartment 72 at one of a variety of temperatures including both true fresh food and freezing temperatures, for example, −18° C., −12° C., −2 C, 0° C. and +4° C. The VCZ compartment 72 is fluidly in communication with the freezer compartment 82 and may include a heater (not shown) for heating the air conveyed to the VCZ compartment 72, if desired. The front panel 74 is part of a drawer assembly 75 that can be withdrawn from the VCZ compartment 72 to grant a user access to food items stored in the VCZ compartment 72. A handle 76 can be coupled to the front panel 74 to allow a user to pull the drawer assembly 75 to an extended position and thereby access the food items.

The freezer compartment 82 is arranged vertically beneath the VCZ compartment 72. A drawer assembly 81 including one or more freezer baskets 83 can be withdrawn from the freezer compartment 82 to grant a user access to food items stored in the freezer compartment 82. The drawer assembly can be coupled to a freezer door 84 that includes a handle 86. When a user grasps the handle 86 and pulls the freezer door 84 open, at least one or more of the freezer baskets 83 is caused to be at least partially withdrawn from the freezer compartment 82.

The freezer compartment 82 is used to freeze and/or maintain articles of food stored in the freezer compartment 82 in a frozen condition. For this purpose, the freezer compartment 82 is in thermal communication with a freezer evaporator (not shown) that removes thermal energy from the freezer compartment 82 to maintain the temperature therein at a temperature of 0° C. or less during operation of the refrigerator 50, preferably between 0° C. and −50° C., more preferably between 0° C. and −30° C. and even more preferably between 0° C. and −20° C. The freezer compartment 82 is also in communication with the VCZ compartment 72 such that a portion of the cooling air supplied to the freezer compartment 82 can be selectively supplied to the VCZ compartment 72.

Figure 3:
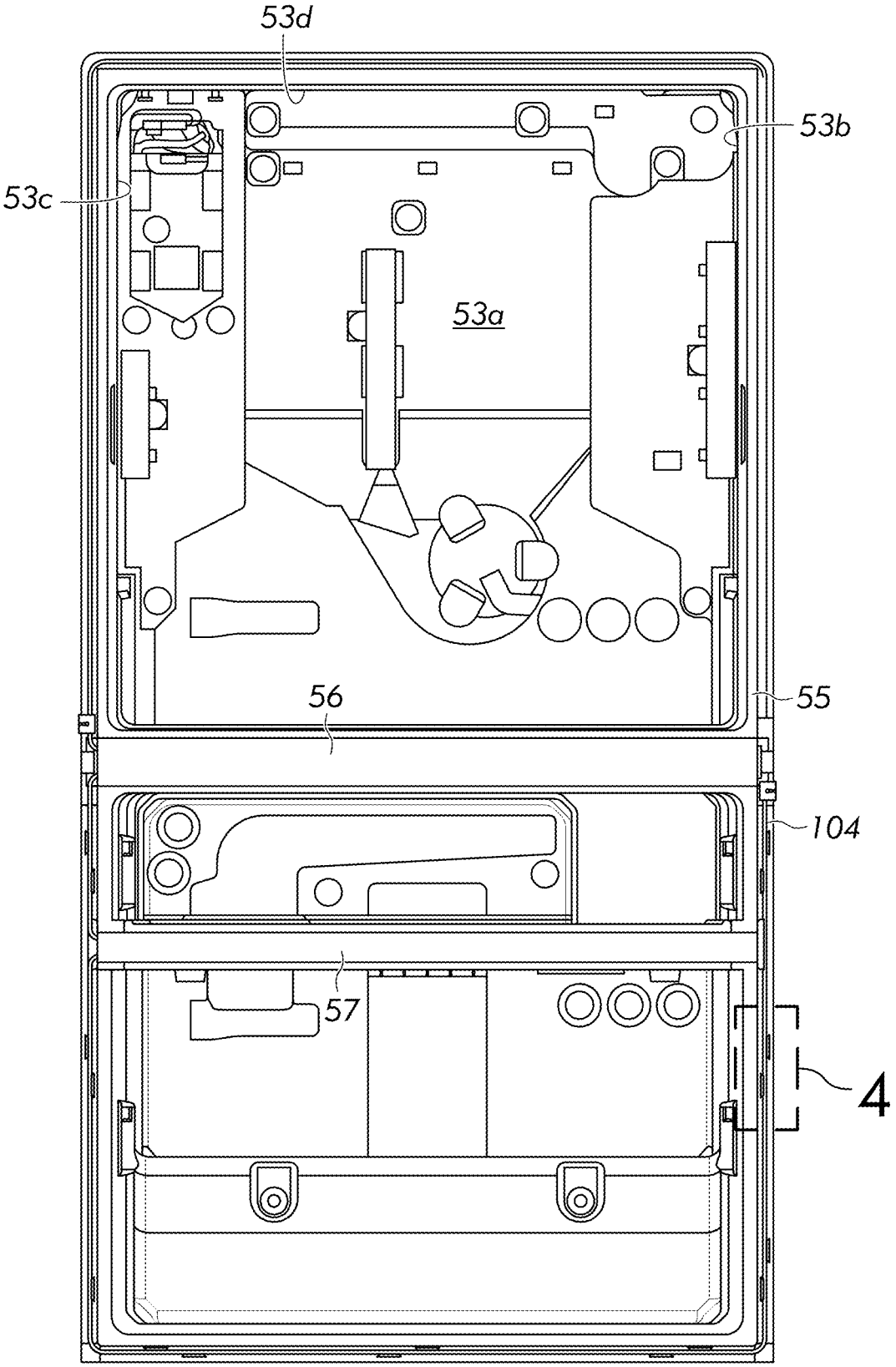
FIG. 3 is a front view of a cabinet for the refrigerator of FIG. 1.

Referring now to FIG. 3, the liner 53 is depicted as defining various compartments within the cabinet 51 of the refrigerator 50. Specifically, the liner 53 is shown as defining the fresh food compartment 52, the VCZ compartment 72 and the freezer compartment 82. The liner includes a rear wall 53*a*, first and second opposing side walls 53*b*, 53*c*, and a top wall 53*d*. Further, the liner 53 includes a front face 55 that circumscribes an access opening of the various compartments. The front face 55 is located at a distal end of the liner 53 and is parallel to the rear wall 53*a* of the liner 53. Although the liner 53 is illustrated as being a singular element that defines all of the fresh food compartment 52, the VCZ compartment 72 and the freezer compartment 82, it is contemplated that separate liners could be used to define each compartment, or combinations thereof. In one optional example, a pair of liners could be used in which one liner defines the fresh food compartment, and a second liner defines the VCZ compartment and the freezer compartment. As shown, a first partition 56 is disposed within the cabinet 51. The first partition 56 separates the cabinet 51 into a fresh food section (i.e., the fresh food compartment 52) and a freezer section (i.e., the VCZ compartment 72 and the freezer compartment 82). Further, a second partition 57 is disposed within the cabinet 51 and separates the freezer section into a first zone (i.e., the VCZ compartment 72) and a second zone (i.e., freezer compartment 82). Specifically, the first and second partitions 56, 57 are both parallel to the top wall 53*d* and extend outwards from the rear wall 53*a* of the liner 53. Moreover, the first and second partitions 56, 57 extend between the first and second opposing side walls 53*b*, 53*c* of the liner 53. In this particular embodiment, the first partition 56 is formed integral with the liner 53 such that the first partition 56 is formed simultaneously with the liner 53, while the second partition 57 is a separate element from the liner 53 and is secured therein after the liner 53 has been formed. However, it is to be appreciated that in an alternate embodiment the reverse may be true. In yet other alternative embodiments, both of the first and second partitions 56, 57 may be separate elements from the liner 53 and are secured therein after the liner 53 has been formed, or the first and second partitions 56, 57 may be formed integral with the liner 53 such that the first and second partitions 56, 57 are formed simultaneously with the liner 53.

Figure 4:
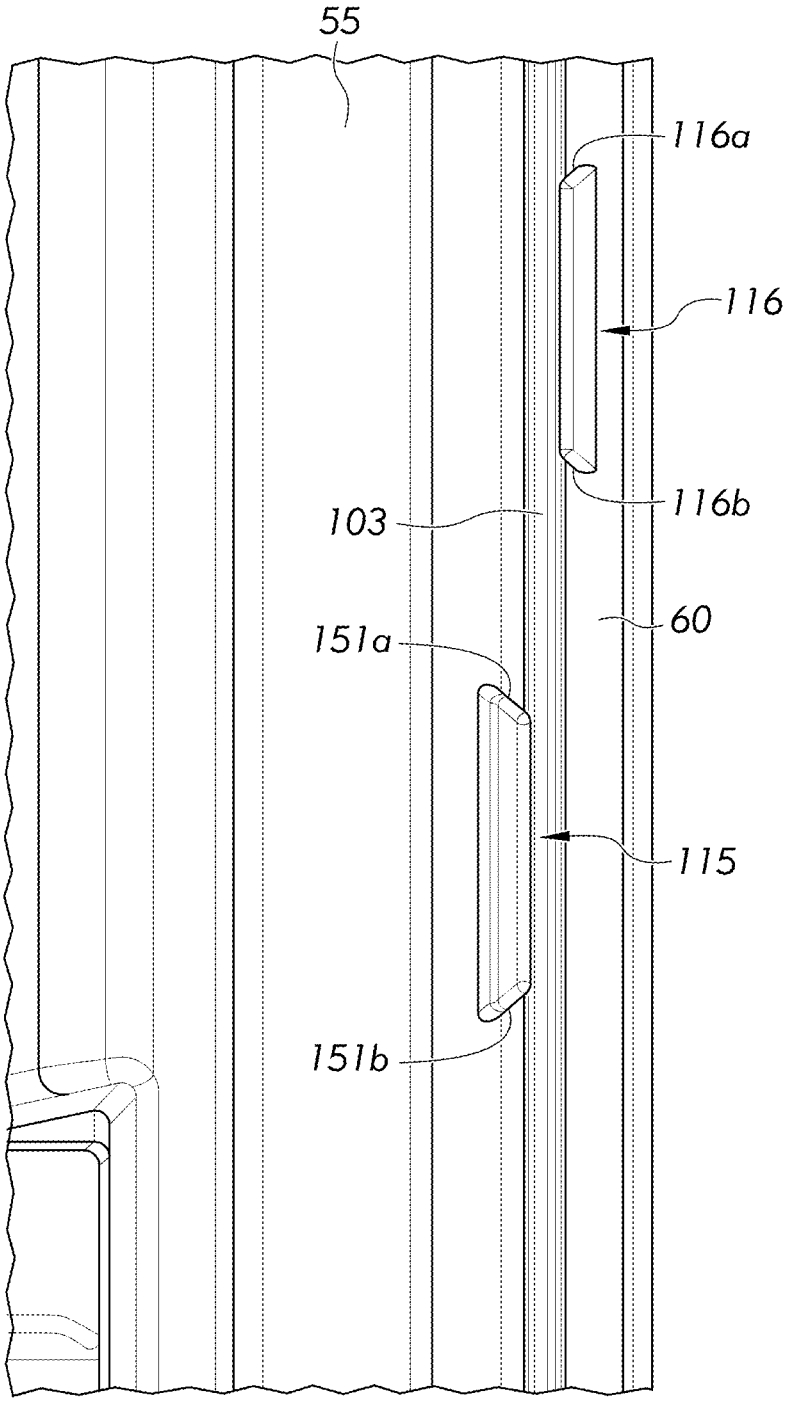
FIG. 4 is enlarged detail view of the encircled area depicted in FIG. 3.

As best shown in FIG. 4, a flange 60 extends outwards in a direction parallel to the front face 55 and away from the access opening. Further, the flange 60 extends about a perimeter of the front face 55. That is, the flange 60 extends outwards from the front face 55 in a direction away from the compartments. In the illustrated example, the flange 60 extends outwards in a direction away from the compartments and perpendicular to an imaginary plane upon which the front face 55 lies. Although it is contemplated that the flange may extend outwards at various other angles. As such, in this example the flange 60 is parallel to the rear wall 53*a* of the liner 53. Further, the flange 60 may extend around the entire front face 55 of the liner 53. That is, in this particular embodiment, the flange 60 extends outwards from the front face 55 about all of the fresh food compartment 52, the VCZ compartment 72 and the freezer compartment 82. However, in alternative embodiments, the flange 60 extends outwards from the front face 55 only about the freezer section.

Moreover, the flange 60 is formed integral with the liner 53 such that the flange 60 and the liner 53 are formed simultaneously (e.g., during a molding operation). Alternatively, the flange 60 may be a separate and distinct element from the liner 53 which is subsequently attached thereto by securing means generally known in the art (e.g., adhesive, tab/slot configuration, etc.). Further, as will be discussed below, the liner 53 includes a recessed pocket 103 formed into the flange 60 along an extended portion of the front face 55. Specifically, the recessed pocket 103 is formed into the portions of the flange 60 that extends outwards from the front face 55 about both the fresh food section and the freezer section. However, in alterative embodiments, the recessed pocket 103 can be formed into the portion of the flange 60 that extends outwards from the front face 55 about only one of the fresh food section and the freezer section.

Preferably, the recessed pocket 103 has a geometry that corresponds to that of the heat pipe to be received therein. The recessed pocket 103 can have a "U" shaped or "C" shaped cross-sectional geometry, and may include a pair of sidewalls connected by a curved bottom or a flat bottom. The recessed pocket 103 may be sufficiently deep to enable to the heat pipe to be fully received therein so that the heat pipe is located below the front face 55 of the flange 60.

Figure 5:
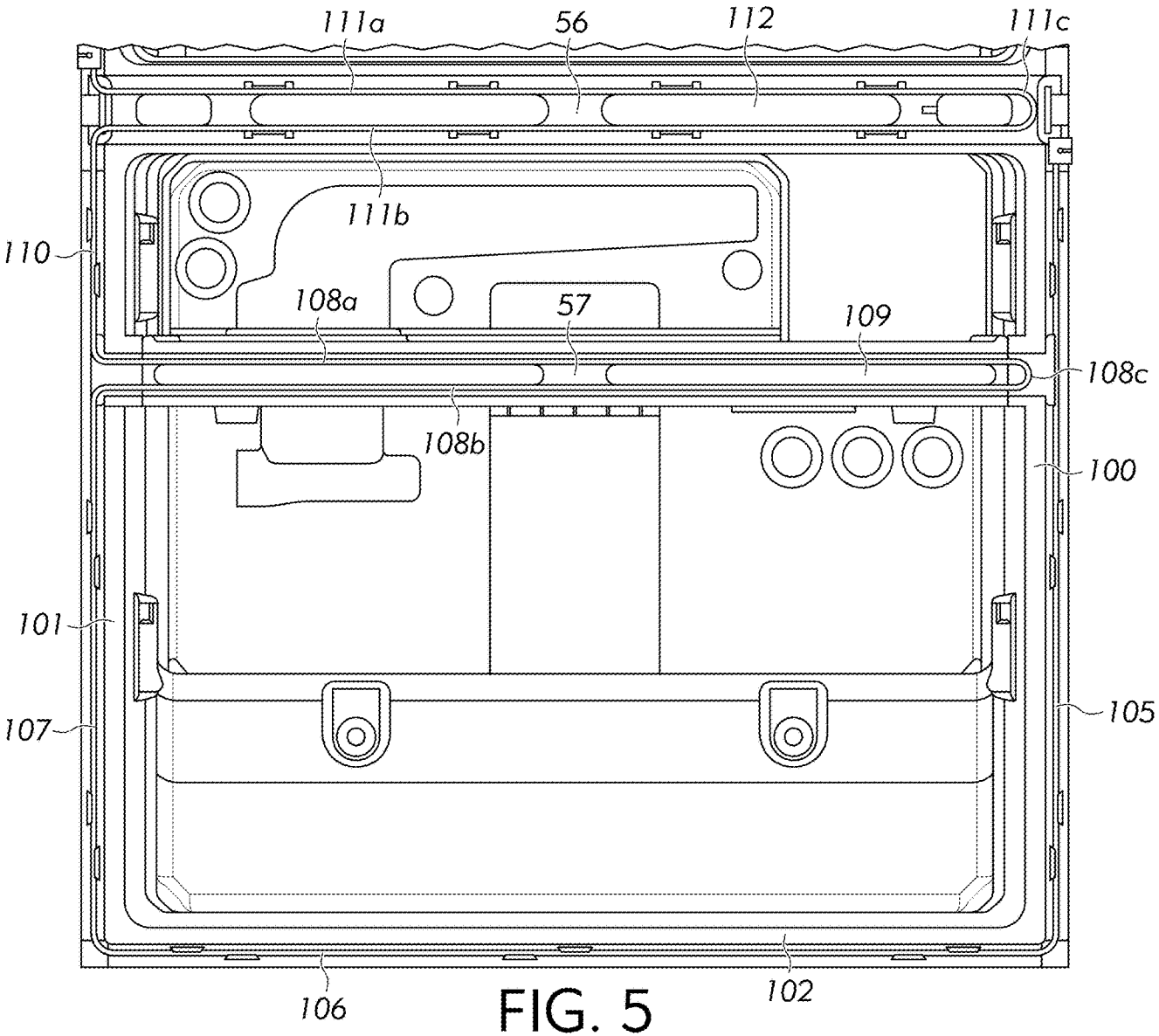
FIG. 5 is a view of a flange extending outwards from a front face of a liner of the cabinet shown in FIG. 3.

Moving on now to FIG. 5, the front face 55 of the freezer section includes a first side segment 100, a second side segment 101 and a bottom segment 102. The first and second side segments 100, 101 are parallel and are both perpendicular to the bottom segment 102. Moreover, the recessed pocket 103 (see FIG. 4) is formed into the flange 60 extending outwards from the first side segment 100, the second side segment 101, and the bottom segment 102. Moreover, a heat pipe is disposed within the recessed pocket 103 in order to reduce and/or eliminate the formation of condensation around the front face 55 of the liner 53. Specifically, in the shown example, the heat pipe is a condenser tube 104 of an evaporative cooling system. The condenser tube 104 includes first and second ends that are connected to a discharge port and an inlet port on the "warm" side of the evaporative cooling system, respectively, to discharge heat into the external environment. Alternatively, it is contemplated that the heat pipe could be an electric resistive heater element, or other heating device.

As shown, the condenser tube 104 is only disposed within a portion of the recessed pocket 103 that is formed into the flange 60 that extends outwards from the front face 55 only about the freezer section. Specifically, the condenser tube 104 includes a first portion 105 that extends vertically along the first side segment 100. The first portion 105 of the condenser tube 104 may optionally extend directly from the evaporative cooling system, or alternatively may extend from other portions of the refrigerator, such as from about the fresh food compartment. That is, the first portion 105 of the condenser tube 104 is disposed within the recessed pocket 103 located on the first side segment 100 of the front face 55. Further, the condenser tube 104 includes a second portion that extends horizontally along the bottom segment 102 of the front face 55. In other words, the second portion 106 of the condenser tube 104 is disposed within the recessed pocket 103 located on the bottom segment 102 of the front face 55. The condenser tube 104 further still includes a third portion 107 that extends vertically along the second side segment 101 of the front face 55 between the bottom segment 102 of the front face 55 and the second partition 57. That is, the third portion 107 of the condenser tube 104 is disposed within a part of the recessed pocket 103 located on the second side segment 101 of the front face 55 and positioned between the bottom segment 102 of the front face 55 and the second partition 57.

The condenser tube 104 further includes a first loop portion that extends horizontally along the second partition 57 between the first and second side segments 100, 101 of the front face 55. In this way, the condenser tube 104 generally circumscribes the opening of the freezer compartment about which the freezer door seal will engage the liner. Specifically, the first loop portion includes a top portion 108*a* disposed above and spaced apart from a bottom portion 108*b*. The top and bottom portions 108*a*, 108*b* are disposed adjacent a front surface of the second partition 57. Optionally, a first projection member 109 extends outwards from the front surface of the second partition 57 and is positioned vertically between the top and bottom portions 108*a*, 108*b* of the first loop portion so as to keep said portions 108*a*, 108*b* separated at a predetermined distance. The top and bottom portions 108*a*, 108*b* are continuously connected by way of a curved end portion 108*c* which is positioned adjacent the first side segment 100 of the front face 55.

Further still, the condenser tube 104 also generally circumscribes the opening of the VCZ compartment about which the VCZ door seal will engage the liner. Specifically, the condenser tube 104 includes a fourth portion 110 that extends vertically along the second side segment 101 of the front face 55 between the second partition 57 and the first partition 56. In other words, the fourth portion 110 of the condenser tube 104 is disposed within a part of the recessed pocket 103 located on the second side segment 101 of the front face and positioned between the second partition 57 and the first partition 56.

The condenser tube 104 still further includes a second loop portion that extends horizontally along the first partition 56 between the first and second side segments 100, 101 of the front face 55. Specifically, the second loop portion includes a top portion 111*a* disposed above and spaced apart from a bottom portion 111*b*. The top and bottom portions 111*a*, 111*b* are disposed adjacent a front face of the first partition 56. Further, a second projection member 112 extends outwards from the front surface of the first partition 56 and is positioned vertically between the top and bottom portions 111*a*, 111*b* of the second loop portion so as to keep said portions 111*a*, 111*b* separated at a predetermined distance. The top and bottom portions 111*a*, 111*b* are continuously connected by way of a curved end portion 111*c* which is positioned adjacent the first side segment 100 of the front face 55. Portion 111*a* of the condenser tube 104 may optionally return directly back to the evaporative cooling system, or alternatively may extend towards other portions of the refrigerator, such as about the fresh food compartment.

As will now be described in detail, the condenser tube 104 is secured within the recessed pocket 103 by retention lugs. The condenser tube 104 may be secured within the recessed pocket 103 only by the retention lugs. In alternative embodiments, the condenser tube 104 may be secured within the recessed pocket 103 by retention lugs as well as other members (e.g., adhesives, fasteners, etc.). As best shown in FIG. 4, the liner 53 includes at least one inner retention lug 115. The inner retention lug 115 is positioned adjacent to, and extends a first distance over, the recessed pocket 103. Further the inner retention lug is located on a side of the recessed pocket closest to the front face 55. The liner 53 further includes at least one outer retention lug 116. The outer retention lug 116 is positioned adjacent to, and extends a second distance over, the recessed pocket 103. In other words, each of the inner and outer retention lugs 115, 116 partially cover the open upper end of the recessed pocket 103 at their respective locations. Further, the outer retention lug 116 is located on a side of the recessed pocket 103 opposite from the inner retention lug 115. Moreover, the inner retention lug 115 is arranged on the flange 60 in a staggered formation with respect to the outer retention lug 116. In this embodiment, the inner and outer retention lugs 115, 116 are formed integral with the flange 60. That is, the liner 53, front face 55, flange 60, recessed pocket 103, and inner and outer retention lugs 115, 116 are formed integral into a single piece during a forming operation (e.g., molding process). Optionally, the retention lugs 115, 116 could be separately attached.

As shown, the first distance that the inner retention lug 115 extends over the recessed pocket 103 is less than the total width of the recessed pocket 103. However, in alternative embodiments, the first distance that the inner retention lug 115 extends over the recessed pocket 103 may be greater than the total width of the recessed pocket 103. For example, the first distance may be greater than the total width of the recessed pocket 103 and the inner retention lug 115 may be spaced outwards from the flange 60 in order to ensure a clearance between the inner retention lug 115 and the flange 60 so as to permit installation of the condenser tube 104 within the recessed pocket 103.

It is noted that the flange 60 is configured such that the inner and outer retention lugs 115, 116 secure the condenser tube 104 within the recessed pocket 103 such that the condenser tube 104 does not protrude beyond the imaginary plane upon which the front face 55 lies. The flange 60 is further configured such that the inner and outer retention lugs 115, 116 secure the condenser tube 104 within the recessed pocket 103 such that the inner and outer retention lugs 115, 116 do not protrude beyond the imaginary plane upon which the front face 55 lies. That is, in one example, the flange 60 may be distanced from the front face 55 in a rearward direction (i.e., towards a rear of the refrigerator) such that neither the condenser tube 104 nor the inner and outer retention lugs 115, 116 protrude beyond the imaginary plane upon which the front face 55 lies. In another example, the inner and outer retention lugs 115, 116 may not extend beyond a front surface of the flange 60 and the recessed pocket 103 may be sufficiently deep such that neither the inner and outer retention lugs 115, 116 nor the condenser tube 104 protrudes beyond said imaginary plane.

Additionally, the first and second distances that the inner and outer retention lugs 115, 116 extend over the recessed pocket 103, respectively, may be the same. Alternatively, the first and second distances that the inner and outer retention lugs 115, 116 extend over the recessed pocket 103, respectively, may be different.

The inner retention lug 115 has a first length spanning between a first forward end 115*a* and a first rearward end 115*b*. Further, the outer retention lug 116 has a second length spanning between a second forward end 116*a* and a second rearward end 116*b*. In this manner, the staggered formation is defined by the inner and outer retention lugs 115, 116 being positioned about the recessed pocket 103 such that the first forward end 115*a* of the inner retention lug 115 is disposed adjacent, and preferably spaced a distance apart from, the second rearward end 116*b* of the outer retention lug, without said inner and outer retention lugs 115, 116 horizontally overlapping. Further still, the first and second lengths of the inner and outer retention lugs 115, 116, respectively, may be the same or different.

With reference to FIG. 5, a plurality of inner retention lugs 115 are equally spaced and disposed along the first and second side segments 100, 101 and the bottom segment 102 of the front face 55. Further, a plurality of outer retention lugs 116 are equally spaced and disposed along the first and second side segments 100, 101 and the bottom segment 102 of the front face 55. For example, as shown, a group of retention lugs may include one inner retention lug 115 and one outer retention lug 116, wherein the first side segment 100, second side segment 101 and the bottom segment 102 have at least one group of retention lugs. Alternatively, the group of retention lugs can include any number of inner and outer retention lugs 115, 116 (e.g., two spaced apart inner retention lugs 115 with an outer retention lug 116 disposed therebetween, or vice versa). In further alternative embodiments, the inner and/or outer retention lugs 115, 116 can be spaced variously along the front face 55, such as periodically, in various patterns, or even randomly. Optionally, only one of the inner and/or outer retention lugs 115, 116 can be used without the other, if desired.

Due to the above-described configuration, the inner and outer retention lugs 115, 116 cause an interference fit with the condenser tube 104 during the installation of said condenser tube 104 into an installed position within the recessed pocket 103. As such, during assembly, the condenser tube 104 is installed within the recessed pocket 103 by being "snap-fit" beyond the inner and outer retention lugs 115, 116. In this manner, no additional elements are required to secure the condenser tube 104 within the recessed pocket 103. Further, due to the interference "snap-fit", the condenser tube 104 is retained within the recessed pocket 103 by the inner and outer retention lugs 115, 116. The condenser tube 104 can be installed into the recessed pocket 103 in sections proceeding around the liner, or the entire condenser tube 104 can be installed into the recessed pocket 103 at one time.

A separate embodiment of the refrigerator 50 will now be described with reference to a drawer assembly. It is understood that the foregoing disclosure of the various elements of the refrigerator 50 are separate and distinct from the additional embodiments discussed below. That is, while the following example embodiment details elements of the refrigerator 50 according to the foregoing example embodiment, the former is not limited to the configuration of the latter and may be employed in other refrigerator configurations. The following described embodiment may be used together with, or entirely separate from, the previous embodiment.

Figure 6:
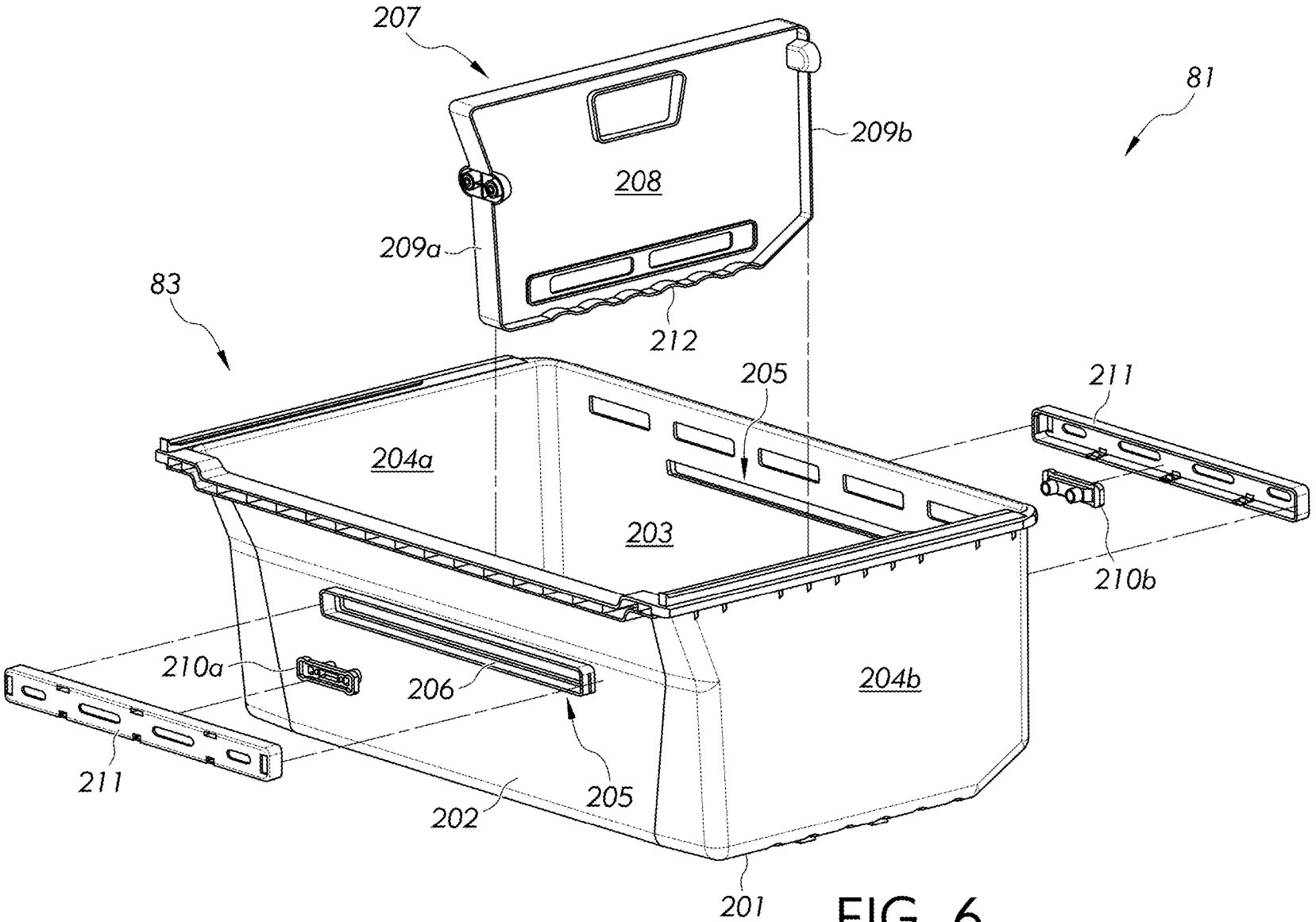
FIG. 6 is an exploded view of a freezer drawer assembly for the refrigerator shown in FIG. 2.

As depicted in FIG. 2, the refrigerator 50 includes multiple cooled compartments (i.e., fresh food compartment 52, VCZ compartment 72, and freezer compartment 82) defined by opposed, first and second interior walls 53*b*, 53*c*. Both the VCZ compartment 72 and the freezer compartment 82 include a respective drawer assembly 75, 81. With reference to FIG. 6, the drawer assembly 81 of the freezer compartment 82 will be described in detail.

As shown, the drawer assembly 81 includes a basket 83 that moves relative to the freezer compartment 82. The basket 83 includes a body 201 having a storage space therein for storing food. The storage space is defined by a front wall 202, a rear wall 203, opposing side walls 204*a*, 204*b*, and a bottom. The opposing side walls 204*a*, 204*b* are adjacent the first and second interior walls 53*b*, 53*c* of the freezer compartment 82. Further, a pair of slots 205 are formed lengthwise into the front and rear walls 202, 203 of the body 201, respectively. The pair of slots 205 are apertures formed into and extending completely through the front and rear walls 202, 203, respectively. Still further, the pair of slots 205 do not extend the entire length of the front and rear walls 202, 203, respectively. The pair of slots 205 define a pair of tracks 206, respectively, which extend outwards and away from the storage space in a lateral direction with respect to the front and rear walls 202, 203.

The drawer assembly 81 further includes a divider 207 disposed within the storage space for dividing the storage space into multiple areas. The divider 207 includes a main surface 208 positioned perpendicular to and extending between the front and rear walls 202, 203. A bottom 212 of the divider 207 is shaped to correspond to an interior surface of the bottom of the basket 83. A handle may be provided towards a top surface of the divider 207 so that a user can easily grasp and slidingly move the divider 207 to the desired location.

The divider 207 further includes a pair of ends 209*a*, 209*b* that are arranged perpendicular to the main surface 208 of the divider 207. A pair of carriages 210*a*, 210*b* are attached to the pair of ends 209*a*, 209*b*, respectively. In other words, one carriage of the pair of carriages 210*a*, 210*b* is secured to each end of the pair of ends 209*a*, 209*b*. The carriage is secured to the end of the divider 207 by screws or bolts; however, it is understood that other securing means may be used (e.g., snaps, clips, adhesives, etc.). Further still, the pair of carriages 210*a*, 210*b* can be formed integral with the divider 207 such that the pair of carriages 210*a*, 210*b* and the divider 207 are formed simultaneously (e.g., during a molding operation).

In an installed position, the pair of carriages 210*a*, 210*b* are positioned within the pair of slots 205, respectively. Preferably, each carriage preferably has an elongated structure to thereby counter-act torque forces (and increased friction) that might otherwise be applied thereto during manual movement of the divider 207. Optionally, each carriage has one or more roller elements, such as wheels, that facilitate motion of the carriage along the tracks. If wheels are present, preferably there are a plurality of wheels arranged along the length of each carriage. Further, the pair of carriages 210*a*, 210*b* engage with and travel along the pair of tracks 206 so as to promote movement of the divider 207 within the storage space to thereby selectively increase and/or decrease the relative sizes of the two storage areas.

As noted above, because the pair of slots 205 do not extend the entire length of the front and rear walls 202, 203, the divider 207 cannot be positioned directly adjacent (i.e., in physical contact with) the opposing side walls 204*a*, 204*b*, and as such, the divider 207 divides the storage space into two storage areas at all times. Additionally, the length of the slots 205 thereby determine the relative maximum and minimum size of the two storage areas. Further, because the bottom 212 of the divider 207 is shaped to correspond to the interior surface of the bottom of the basket 83, as the divider moves within the storage area (i.e., traversing in a direction parallel to the front and rear walls 202, 203), the bottom 212 of the divider 207 may contact the bottom of the basket 83. In this manner, an uninterrupted movement can be achieved. Alternatively, a space may be provided between the bottom 212 of the divider 207 and the interior surface of the bottom of the basket 83 such that the bottom 212 of the divider 207 does not contact the basket 83 in any position.

The drawer assembly 81 also includes a pair of caps 211 that, in the installed position, are secured to the pair of tracks 206, respectively. In this manner, the pair of caps 211 enclose the pair of slots 205, respectively, from outside of the body 201 of the drawer assembly 81. Alternatively, the pair of slots 205 can be apertures formed into but not extending completely through the front and rear walls 202, 203 by integrally including the caps as non-removable walls.

Figure 7:
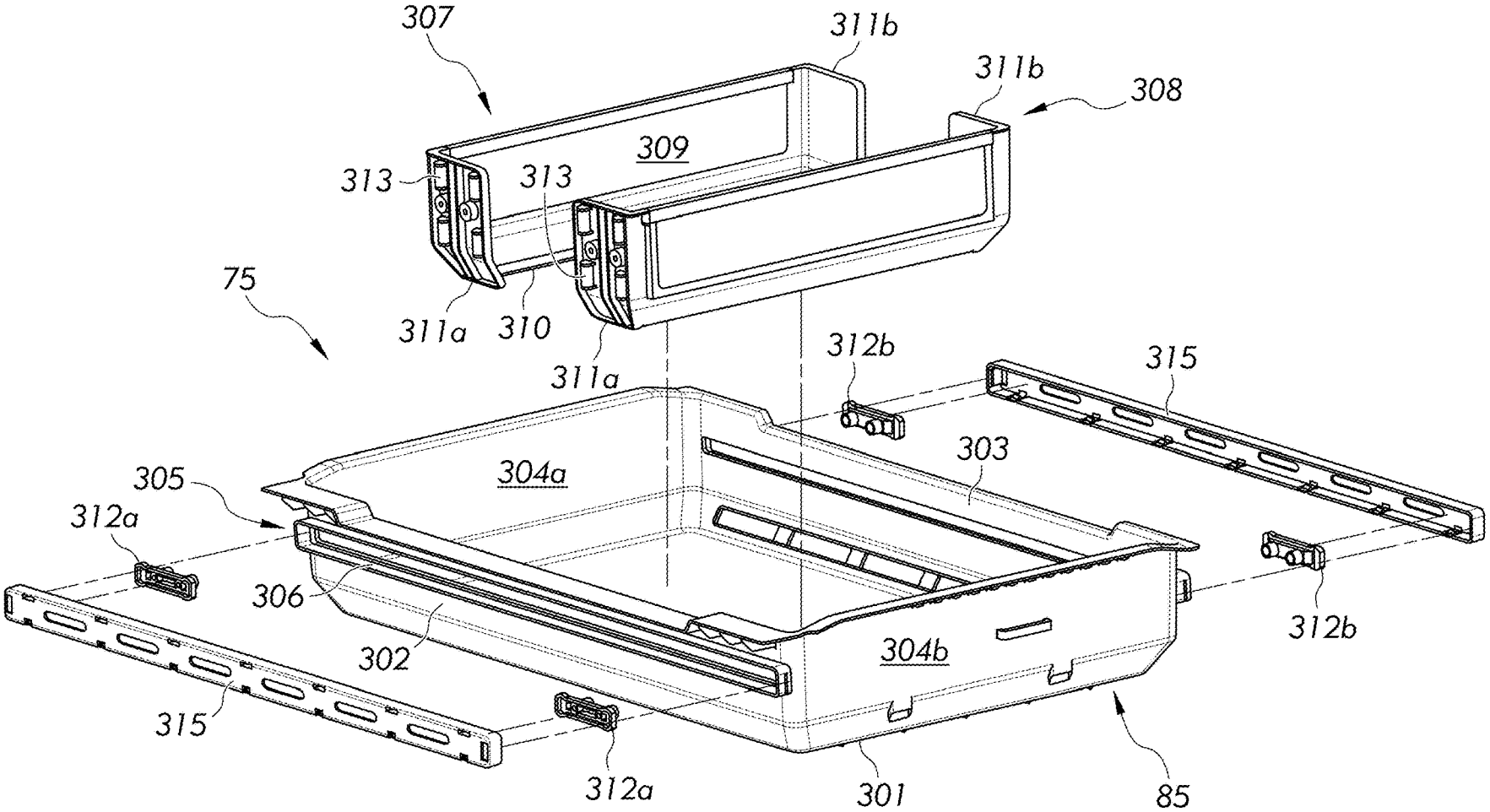
FIG. 7 is an exploded view of a variable climate zone drawer assembly for the refrigerator shown in FIG. 2.

Moving on to FIGS. 7-9, the drawer assembly 75 of the VCZ compartment 72 will now be described in detail. As shown in FIG. 7, the drawer assembly 75 includes a basket 85 that moves relative to the VCZ compartment 72. The basket 85 includes a body 301 having a storage space therein for storing food. The storage space is defined by a front wall 302, a rear wall 303, opposing side walls 304*a*, 304*b*, and a bottom. The opposing side walls 304*a*, 304*b* are adjacent the first and second interior walls 53*b*, 53*c* of the VCZ compartment 72. Further, a pair of slots 305 are formed lengthwise into the front and rear walls 302, 303 of the body 301, respectively. The pair of slots 305 are apertures formed into and extending completely through the front and rear walls 302, 303, respectively.

As depicted, the pair of slots 305 extend the entire length of the front and rear walls 302, 303, respectively. Alternatively, the pair of slots 305 may not extend the entire length of the front and rear walls 302, 303, respectively. Further, the pair of slots 305 define a pair of tracks 306, respectively, which extend outwards and away from the storage space in a lateral direction with respect to the front and rear walls 302, 303.

The drawer assembly 75 for the VCZ compartment 72 further includes a divider disposed within the storage space for dividing the storage space into multiple areas. Specifically, in this example embodiment, the divider includes a first divider member 307 and a second divider member 308, both of which having a "U" shaped geometry. The first and second divider members 307, 308 are selectively separable from one another. That is, in an attached state, the first and second divider members 307, 308 may be selectively secured to one another via attaching means (i.e., tab and slot configurations, etc.) such that, movement of one of the first and second divider members 307, 308 will likewise move the other. Further, in a separated state, the first and second divider members 307, 308 are separated from one another such that the first and second divider members 307, 308 are independently movable within the storage space.

The first divider member 307 will now be described in detail. It is to be understood that the second divider member 308 has the same structure as that of the first divider member 307, although they could be different. For brevity, disclosure with respect to the configuration of the second divider member 308 is omitted herefrom.

The first divider member 307 includes a main surface 309 positioned perpendicular to and extending between the front and rear walls 302, 303. Further, a bottom 310 of the first divider member 307 is shaped to correspond to a shape of the bottom of the basket 85. Specifically, as shown, the bottom 310 is planar and parallel to the bottom of the basket 85. Although not shown, the divider members 307, 308 may each include a handle.

The first divider member 307 includes a pair of ends 311*a*, 311*b* that are arranged perpendicular to the main surface 309 of the first divider member 307. A pair of carriages 312*a*, 312*b* are attached to the pair of ends 311*a*, 311*b*, respectively. That is, one carriage of the pair of carriages 312*a*, 312*b* is secured to each end of the pair of ends 311*a*, 311*b*. Optionally, the pair of ends 311*a*, 311*b* each includes bearings 313.

In an installed position, the pair of carriages 312*a*, 312*b* are positioned within the pair of slots 305, respectively. Further, the pair of carriages 312*a*, 312*b* engage with and travel along the pair of tracks 306 so as to promote movement of the first divider member 307 within the storage space. Preferably, each carriage preferably has an elongated structure to thereby counter-act torque forces (and increased friction) that might otherwise be applied thereto during manual movement of the divider 307. Optionally, each carriage has one or more roller elements, such as wheels, that facilitate motion of the carriage along the tracks. If wheels are present, preferably there are a plurality of wheels arranged along the length of each carriage. Further, the bearings 313 positioned on each of the pair of ends 311*a*, 311*b* contact an interior surface of the front and rear walls 302, 303, respectively, which ensures smooth movement of the first divider member 307 in a direction between the opposing side walls 304*a*, 304*b* of the basket 85.

As noted above, the pair of slots 305 extend the entire length of the front and rear walls 302, 303. As such, the first divider member 307 can be positioned directly adjacent (i.e., in physical contact with) the opposing side wall 304*a*. Due to this configuration, when both the first and second divider members 307, 308 are in the installed position, the first and second divider members 307, 308 can be separately positioned directly adjacent the opposing side walls 304*a*, 304*b*, respectively, such that the storage space is undivided. From this arrangement, moving either the first divider member 307 or the second divider member 308 away from its respective opposing side wall 304*a*, 304*b* divides the storage space into two storage areas. Further still, if both the first and second divider members 307, 308 are moved away from their respective opposing side walls 304*a*, 304*b*, and are not combined together (i.e., the first and second divider members 307, 308 are in the separated state) then the storage space is divided into three storage areas. Lastly, if the first and second divider members 307, 308 coupled together in the combined state, then the storage space is divided into three storage areas with the area between the first and second divider members 307, 308 being fixed at a predetermined size.

Further still, the drawer assembly 75 also includes a pair of caps 315 that, in the installed position, are secured to the pair of tracks 306, respectively. In this manner, the pair of caps 315 enclose the pair of slots 305, respectively, from outside of the body 301 of the drawer assembly 75. Alternatively, the pair of slots 305 can be apertures formed into but not extending completely through the front and rear walls 302, 303 by integrally including the caps as non-removable walls.

Figure 8:
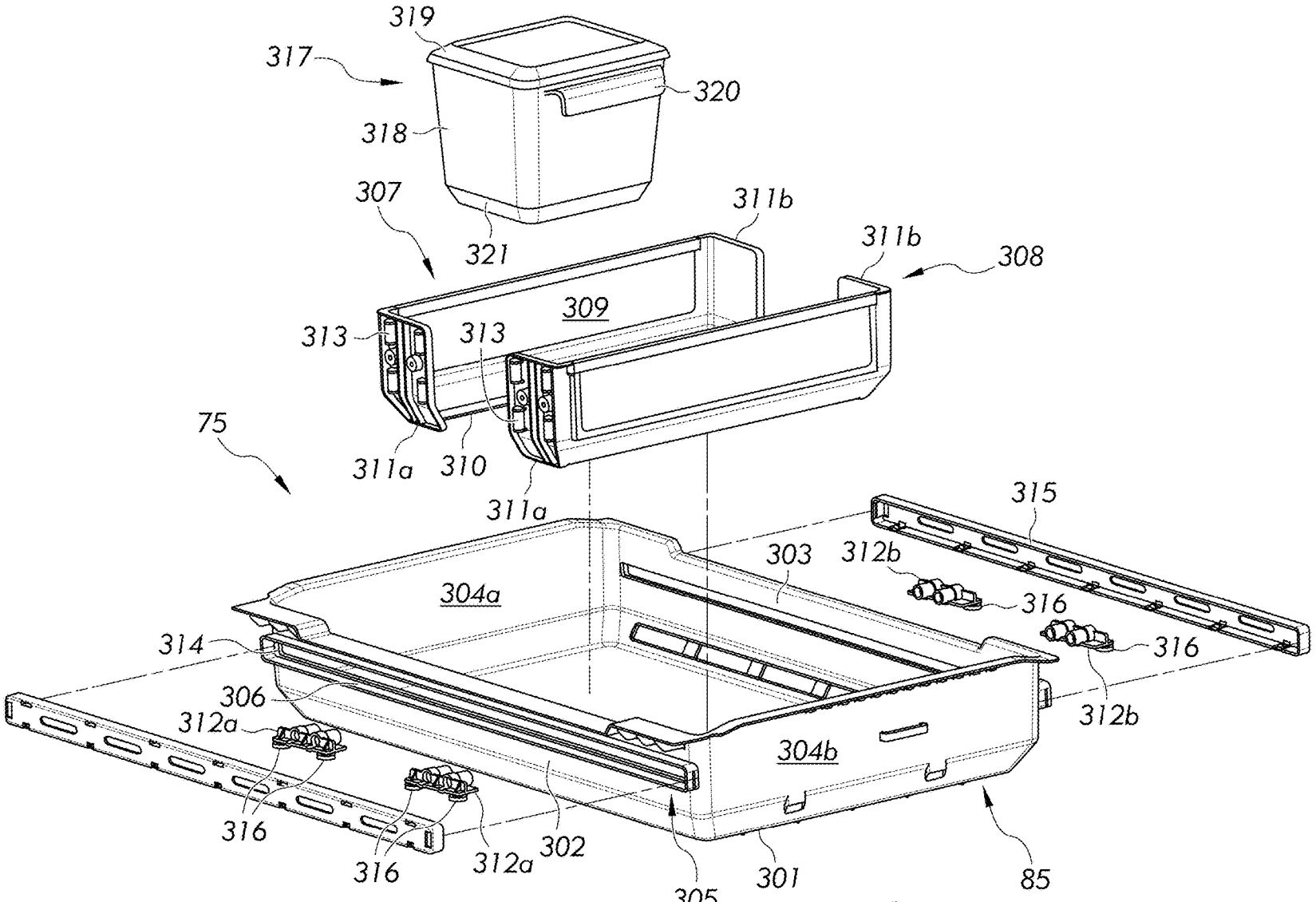
FIG. 8 is an exploded view of an alternative variable climate zone drawer assembly for the refrigerator shown in FIG. 2.

Moving on, FIG. 8 details an alternative embodiment of the drawer assembly 75 for the VCZ compartment 72. Specifically, as shown, each track of the pair of tracks 306 includes an extension member 314 that protrudes vertically upwards. Further, each carriage of the pair of carriages 312*a*, 312*b* for each of the first and second divider members 307, 308 includes at least one wheel 316. In the installed position, the wheel 316 engages a vertically oriented surface of the extension member 314 of the track 306 in order to promote smooth motion of the first and/or second divider members 307, 308 within the storage space. Although the extension member 314 is illustrated towards the bottom of the tracks 306, it is contemplated that the extension member 314 could be located towards the top of the tracks 306, and the wheels 316 could be likewise positioned on the top of the carriages 312*a*, 312*b*. Further, the extension member 314 could be located on both the top and bottom of the tracks 306, with wheels located on either or both of the top and bottom of the carriages 312*a*, 312*b*.

Optionally, as further shown in FIG. 8, the drawer assembly 75 of the VCZ compartment 72 includes a storage bin 317 positioned between the first and second divider members 307, 308. The storage bin 317 includes a body 318 defining a body storage area, and a lid 319 removably secured to the body 318. The lid 319 provides selective access to the body storage area. For example, the lid 319 can be snap-fit to the body 318 such that the lid 319 can be completely separated from the body (i.e., no intervening members connecting the lid 319 to the body 318). Alternatively the lid 319 may be removably secured to the body 318 by a hinge such that the lid 319 is rotatably connected to the body 318 to provide access to the body storage area.

The body 318 includes a downwardly oriented bracket 320 extending from a side wall of the body 318. Specifically, the bracket 320 has a first portion that extends outwards and away from the body 318 in a horizontal direction and a second portion that extends downwards in a perpendicular direction with respect to the first portion. Although only a single bracket 320 is shown, it is contemplated that the body 318 may include a plurality of brackets, such as one on each opposite side for engagement with both of the first divider member 307 or second divider member 308. The bracket 320 is shown as being formed integral with the body 318. That is, the body 318 and bracket 320 are formed simultaneously (e.g., during a molding process). In alternative embodiments, the bracket 320 can be physically separate from the body 318 such that subsequent attachment (via fasteners, adhesives, etc.) is required after the body 318 has been formed.

In an installed positon, the bracket 320 interacts with the main surface 309 of either the first divider member 307 or second divider member 308 to secure the storage bin 317 thereto. For example, in the installed position, the main surface 309 of the second divider member 308 is positioned between the body 318 and the bracket 320 of the storage bin 317. In this manner, the storage bin 317 is secured to the second divider member 308 and can slide along the main surface 309 of the second divider member 308 in a direction parallel to the opposing side walls 304*a*, 304*b*. To further promote the sliding relationship between the storage bin 317 and the second divider member 308, a bottom portion 321 of the body 318 is shaped to correspond to a bottom portion of the second divider member 308.

Figure 9:
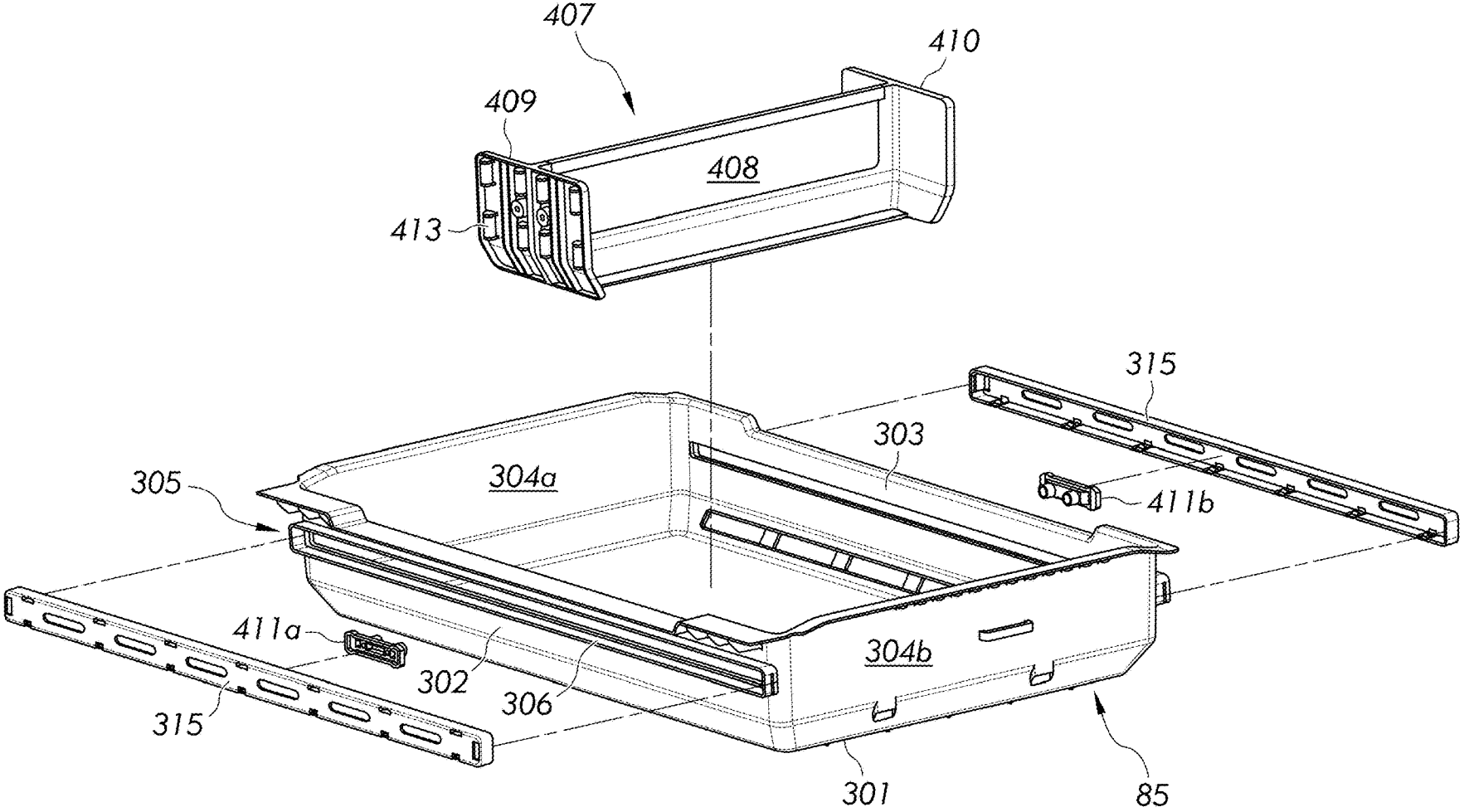
FIG. 9 is an exploded view of another alternative variable climate zone drawer assembly for the refrigerator shown in FIG. 2.

FIG. 9 also details an alternative embodiment of the drawer assembly 75 for the VCZ compartment 72. Specifically, the drawer assembly 75 includes a single "I"-shaped divider member 407 having a main surface 408 arranged perpendicular to the front and rear walls 302, 303 of the basket. Further, the pair of ends of the divider member 407 include a first side portion 409 and a second side portion 410, respectively. That is, the first and second side portions 409, 410 are perpendicular to the main surface 408 and extend along a direction being parallel to the front and rear walls 302, 303, respectively. As shown, the first and second side portions 409, 410 include a pair of carriages 411*a*, 411*b*, respectively. Although the carriages 411*a*, 411*b* appear similar to those shown and described in FIG. 7, it is contemplated that carriages similar to those shown and described in FIG. 8 could be used instead. Optionally, bearings 413 are disposed on each of the first and second side portions 409, 410 of the divider 407. The bearings 413 engage with the interior surface of the front and rear walls 302, 303, respectively. Although not shown, the divider member 407 may include a handle.

In this example embodiment, the main surface 408 of the divider member 407 is spaced away from the opposing side walls 304*a*, 304*b*, at all times, by the first and second side portions 409, 410. That is, if the divider member 407 is located in a position closest to the side wall 304*a*, the first and second side portions 409, 410 will contact the side wall 304*a* and thus space the main surface 408 of the divider member 407 from the side wall 304*a*. The same is true if the divider member 407 is located in a position closest to the opposite side wall 304*b*. The length of the first and second side portions 409, 410 from the main surface 408 thereby determine the relative maximum and minimum size of the two storage areas. As such, the storage space is divided into two storage areas at all times.

Yet another separate embodiment of the refrigerator 50 will now be described with reference to an air tower, which may be used together with or entirely separate from the other embodiments described herein. It is understood that the foregoing disclosure of the various elements of the refrigerator 50 are separate and distinct from the additional embodiments discussed below. That is, while the following example embodiment details elements of the refrigerator 50 according to the foregoing example embodiments, the former is not limited to the configurations of the latter and may be employed in other refrigerator configurations.

Figure 10:
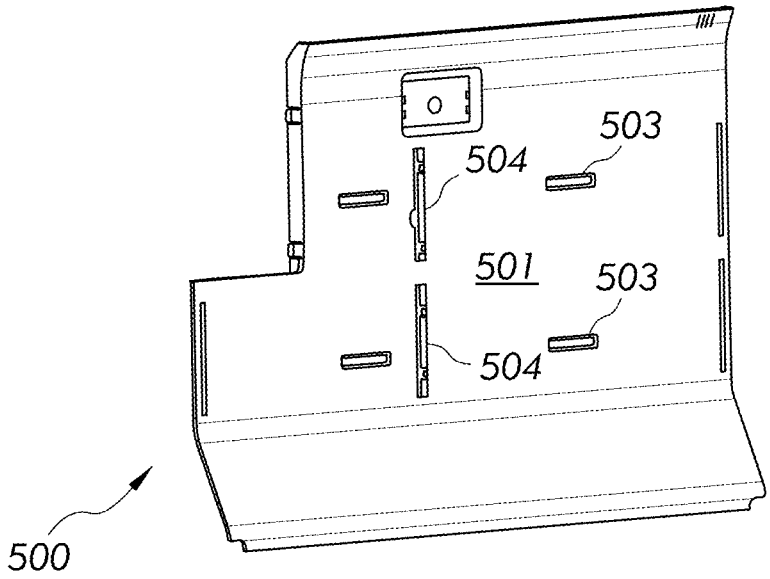
FIG. 10 is a front perspective view of an air tower.
Figure 11:
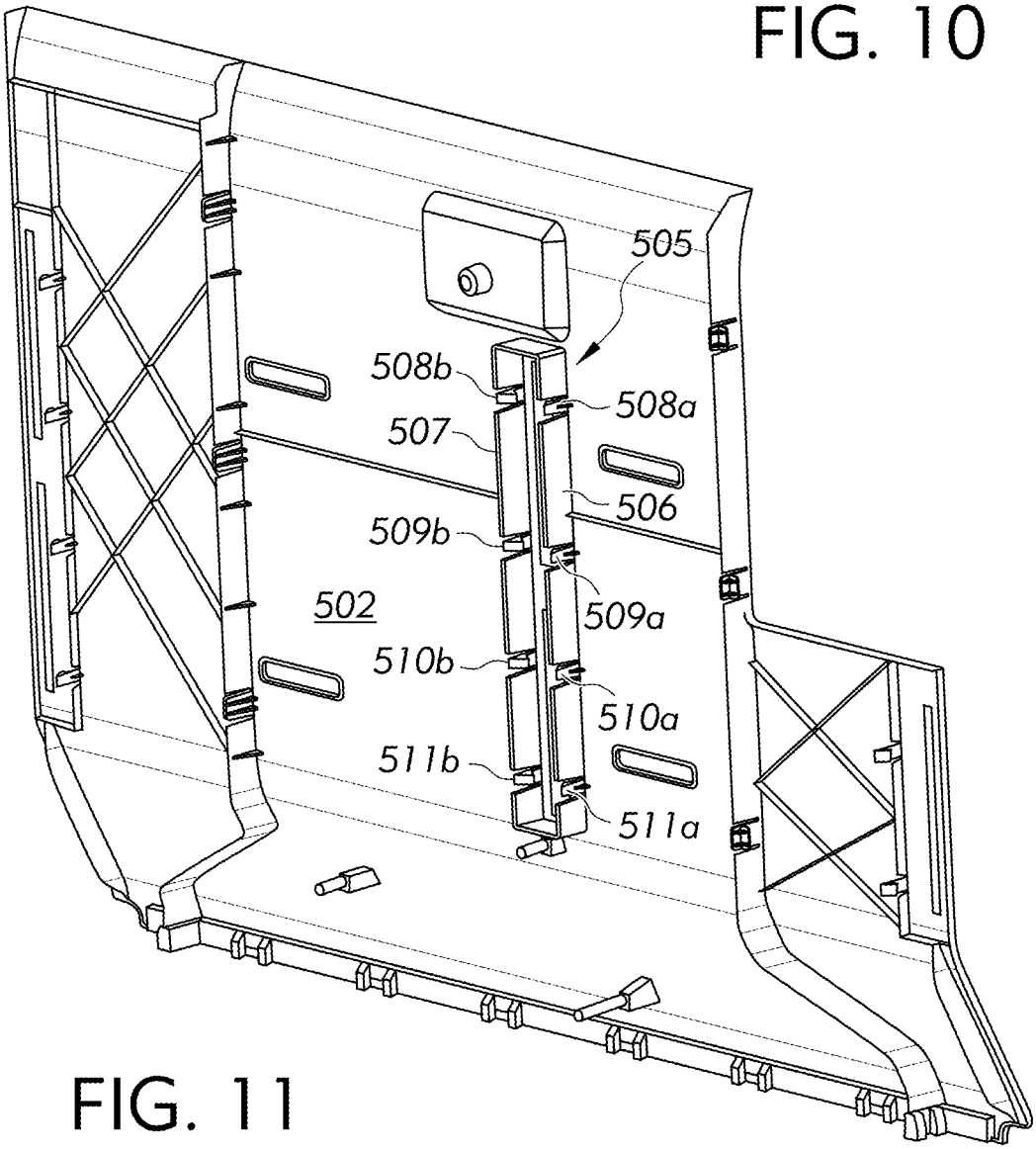
FIG. 11 is a rear perspective view of the air tower shown in FIG. 10.

An air tower 500 is depicted in FIG. 10 that is to be located within the fresh food compartment 52 of the refrigerator 50, although it could be utilized in a freezer compartment. Specifically, the air tower 500 is positioned adjacent the rear wall 53*a* of the liner 53. The air tower 500 has a front surface 501 and an opposing rear surface 502 (as shown in FIG. 11) and includes a plurality of exhaust openings 503 that place the air tower in fluid communication with the fresh food compartment 52. Cooled airflow from a fresh food evaporator unit, or other airflow passage, may extend upwards behind the air tower 500 and be exhausted into the fresh food compartment via the plurality of exhaust openings 503. The air tower 500 further includes at least one reception opening 504. Both the plurality of exhaust openings 503 and the at least one reception opening 504 are apertures formed in the air tower. In other words, each of the exhaust openings 503 and reception openings 504 extends through the air tower 500 from the front surface 501 to the rear surface 502.

As shown in FIG. 11, the air tower 500 includes an extension member 505 that extends outward and away from the rear surface 502 of the air tower 500. Specifically, the extension member 505 circumscribes the reception opening 504 and includes opposing longitudinal sides 506, 507. Further, first and second clips 508*a*, 508*b* are positioned at the opposing longitudinal sides 506, 507, respectively. The first and second clips 508*a*, 508*b* are arranged on the opposing longitudinal sides 506, 507, respectively, such that the first and second clips 508*a*, 508*b* are horizontally aligned. The first and second clips 508*a*, 508*b* are formed integral with the extension member 505 such that the first and second clips 508*a*, 508*b* and the extension member 505 are formed simultaneously (e.g., during a molding operation). The first and second clips 508*a*, 508*b* have a flexible living hinge so as to be resiliently moveable with respect to the extension member 505.

Further still, a plurality of first clips 508*a*-511*a* and a plurality of second clips 508*b*-511*b* can be positioned at the opposing longitudinal sides 506, 507 of the extension member 505, respectively, and can be arranged thereon such that each first clip 508*a*-511*a* is horizontally aligned with each respective second clip 508*b*-511*b*.

Figure 12:
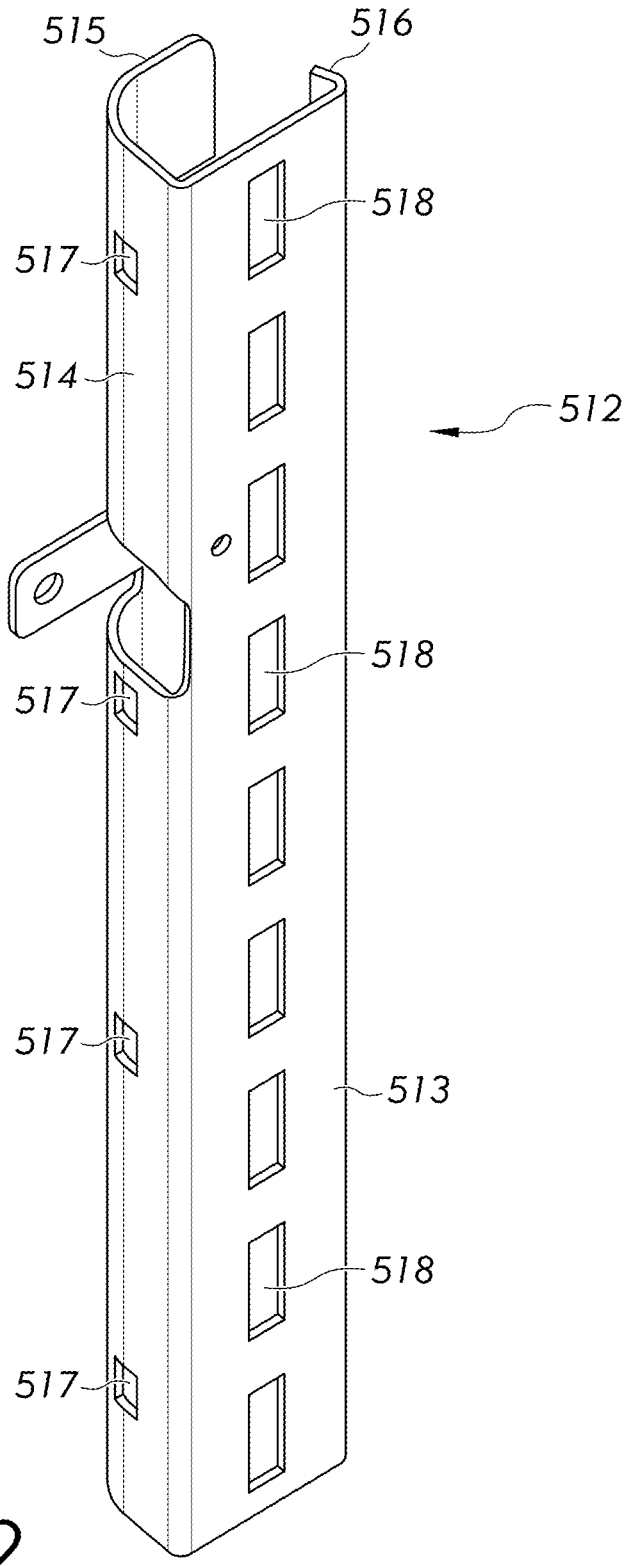
FIG. 12 is a perspective view of a rail.

FIG. 12 depicts a ladder track or rail 512 that is use to support one or more shelf support arms within the refrigerator. The ladder track or rail 512 includes a front surface 513, a side surface 514 and a rear surface 515. The front, side, and rear surfaces 513, 514, 515 are one continuous member that is shaped according to known processes (e.g., bending, rolling, extruding, etc.). A flange member 516 extends from a distal end of the front surface 513 in a rearward direction away from the front surface 513. Further, the side surface 514 of the rail 512 includes at least one securing opening 517 that extends through the side surface 514 of the rail 512. Further still, the front surface 513 of the rail 512 includes a plurality of receiving openings 518 that accept legs of a shelf therein.

Figure 13:
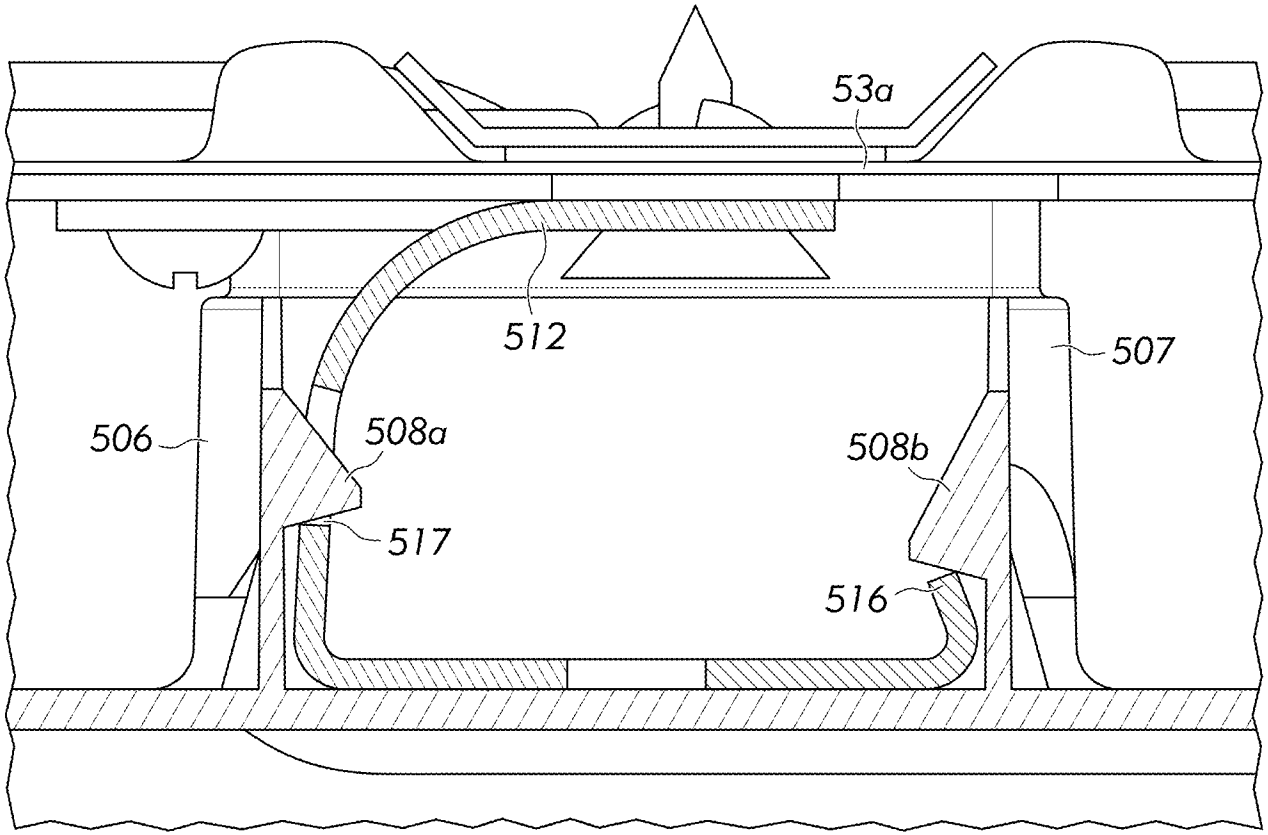
FIG. 13 is a cross-section of the rail and the air tower in an installed position.

In an installed position, as depicted in FIG. 13, the rail 512 is secured to the rear wall 53*a* of the liner 53. The rail 512 is shown as being secured to the rear wall 53*a* via a screw attached to a suitable anchor. Alternatively, the rail 512 may be secured to the rear wall 53*a* via other methods know to those skilled in the art (e.g., adhesives, slot and tab configurations, etc).

The air tower 500 is disposed adjacent the rear wall 53*a* of the liner 53 such that the reception opening 504 coincides with the location of the rail 512. As shown, the rail 512 is positioned between the opposing longitudinal sides 506, 507 of the extension member 505 and is removably attached thereto. Specifically, the first clip 508*a* is disposed within the securing opening 517 while the second clip 508*b* engages with the flange member 516 of the rail 512. Of note, the flange member 516 does not contact the rear surface 515 of the rail 512. As such, only one side (i.e., the side surface 514) of the rail 512 includes the securing opening 517 configured to accept the first clip 508*a* therein. Further, both the first and second clips 508*a*, 508*b* are resilient members such that they can be bent in an outwards direction to allow installation and removal of the air tower 500. This permits the entire air tower 500 to be readily affixed to the liner by way of a single snap-fit step. Additionally, although the clips 508*a*, 508*b* have been described as being located about a single ladder track, it is to be appreciated that refrigerators often include multiple shelf support rails, and the air tower 500 may include additional clips 508*a*, 508*b* arranged variously to engage with some or all of the other shelf support rails.

A further separate embodiment of the refrigerator 50 will now be descried with reference to a center flip mullion assembly, which may be used together with or entirely separate from the other embodiments described herein. As depicted in FIG. 2, the refrigerator 50 includes a first door 54 pivotally coupled to the cabinet 51 at a first side, and a second door 54 pivotally coupled to the cabinet 51 at a second side, wherein the second side of the cabinet 51 is opposite the first side of the cabinet 51. Further, as shown in FIG. 1, the first and second doors 54 collectively span a lateral distance between the first and second sides such that the first and second doors 54 permit selective access to the fresh food compartment 52. As briefly discussed above, a center flip mullion assembly 58 is positioned on one of the first and second doors 54.

Figure 14:
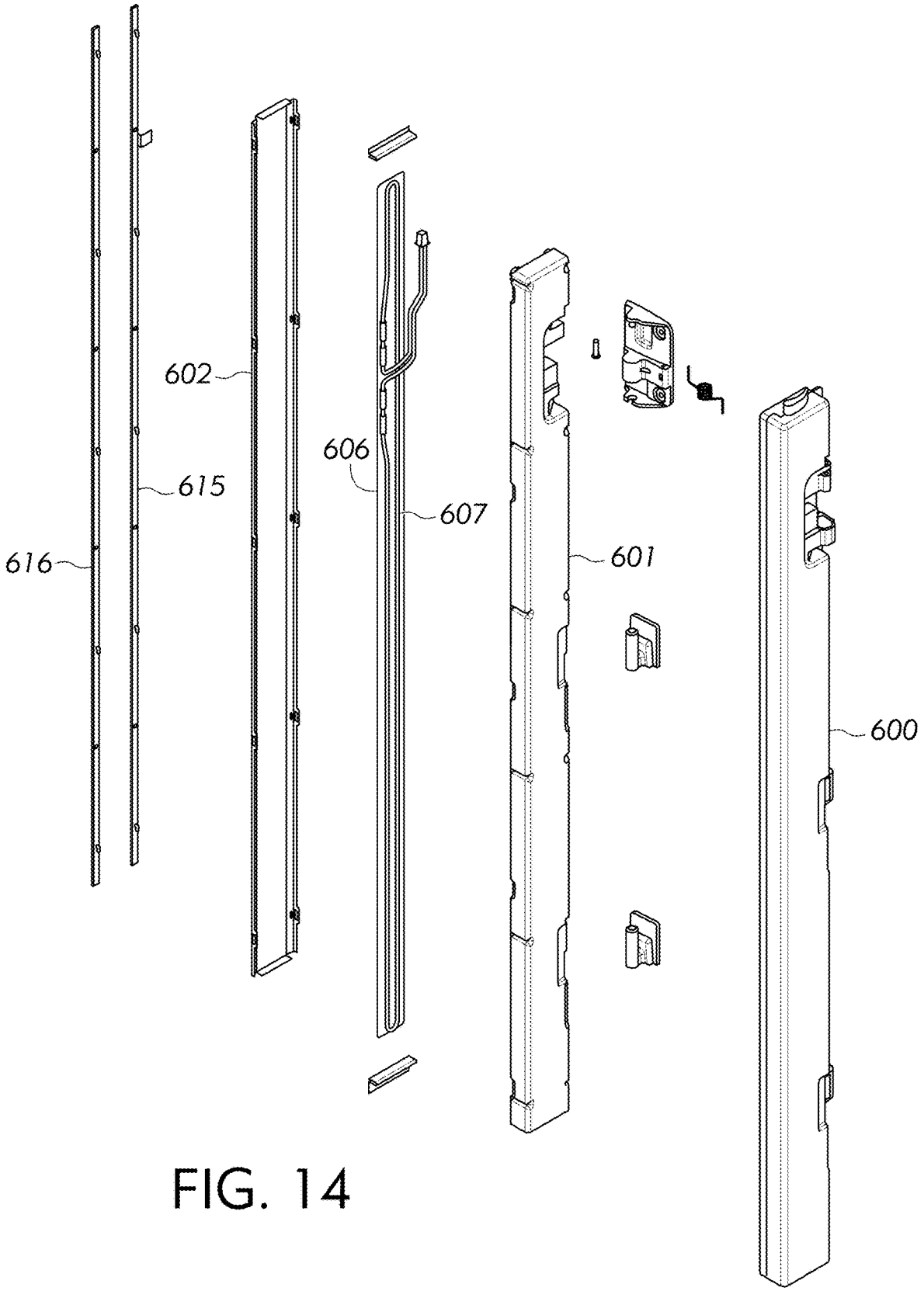
FIG. 14 is an exploded view of a center flip mullion assembly.

Turning now to FIG. 14, the center flip mullion assembly 58 includes a base member 600, a body member 601 inserted within the base member 600, and a front plate 602 positioned over the body member 601. The center flip mullion assembly 58 further includes an adhesive 606, such as an aluminum tape, and a heater 607. Preferably, the heater 607 is an electric resistive heater element. The adhesive 606 may be disposed on either side of the heater 607.

Figure 15:
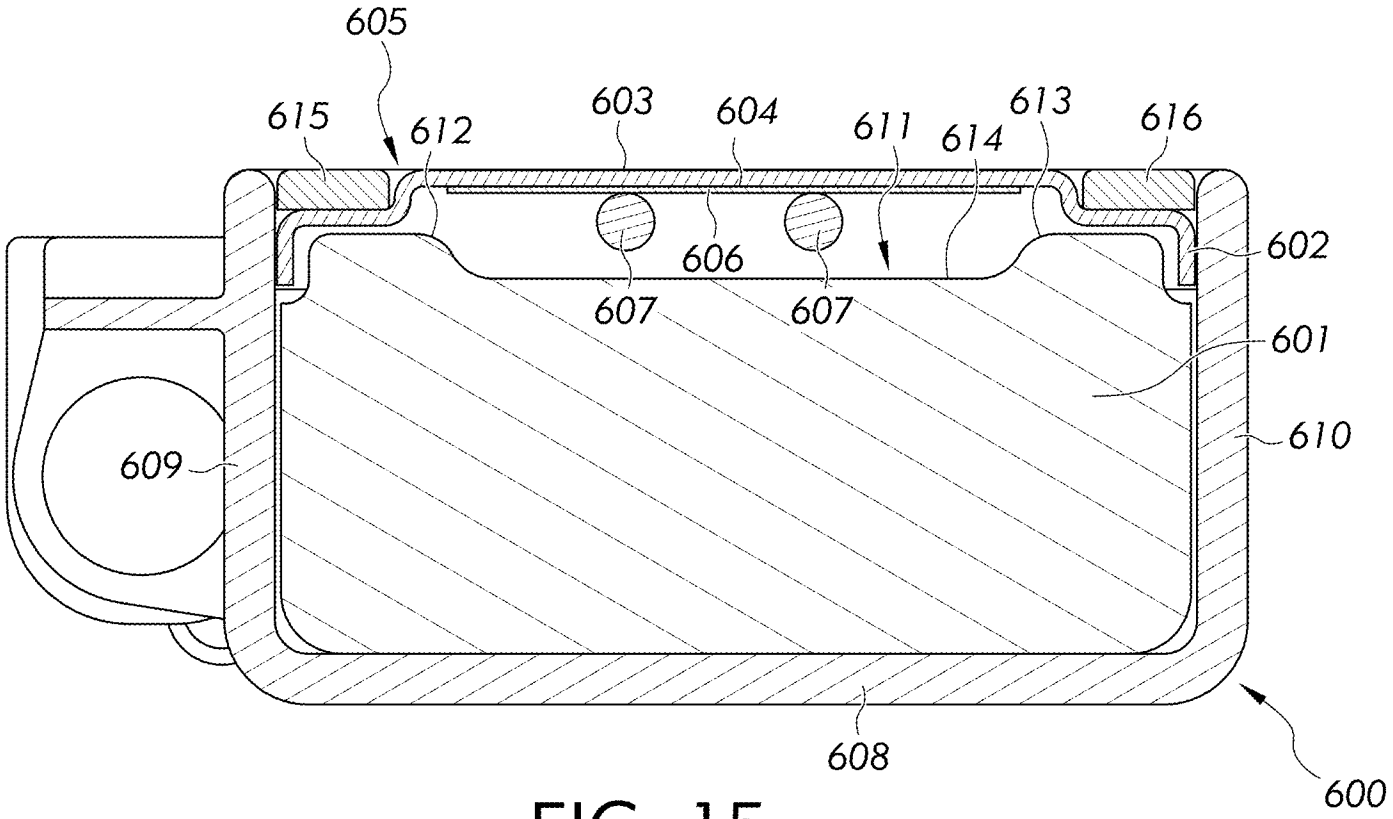
FIG. 15 is a cross-sectional view of the center flip mullion assembly shown in FIG. 14.

As depicted in FIG. 15, the base member 600 includes a bottom wall 608 and first and second opposing side walls 609, 610 that extend, in a perpendicular direction, away from the bottom wall 608 of the base member 600. In an installed position, the body member 601 is inserted within the base member 600 and is positioned between the first and second opposing side walls 609, 610. Preferably, the body member 601 is an insulation foam.

The body member 601 includes a recess 611 defined between opposing first and second protrusions 612, 613 which extend outwards and away from a front face 614 of the body member 601. In the installed position, the front plate 602 is positioned over the body member 601 such that the front plate 602 extends between the first and second opposing side walls 609, 610 and covers the recess 611. The front plate 602 includes a front surface 603, a rear surface 604, and a raised portion 605. The raised portion 605 is positioned to be substantially co-extensive with the ends of the first and second opposing side walls 609, 610. Preferably, the front plate 602 is a metal plate with a relatively high heat transfer coefficient. The adhesive 606 is disposed on a portion of the rear surface 604 of the front plate 602 and the heater 607 is attached to the adhesive 606 such that, in the installed position, the heater 607 is positioned in close proximity to the rear face of the front plate 602 and within the recess 611. In this manner, the heater 607 is disposed in an area positioned directly between the front plate 602 (via the adhesive 606) and the body member 601.

As further shown, a first gap is defined between the first opposing side wall 609 and the raised portion 605, and a second gap is defined between the second opposing side wall 610 and the raised portion 605. First and second gaskets 615, 616 are positioned within the first and second gaps, respectively. Preferably, the first and second gaskets 615, 616 comprise a high temperature plastic material that act as insulators between the relatively warm front plate 602 and the opposing side walls 609, 610.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims and their equivalents.

The invention claimed is:

1. A refrigerator comprising:

a cabinet;

a liner defining a compartment within the cabinet, the liner comprising:

a front face circumscribing an access opening of said compartment;

a flange extending outwards from the front face in a direction parallel to the front face and away from the access opening, the flange extending about a perimeter of the front face;

a recessed pocket formed into the flange along an extended portion of the front face;

at least one inner retention lug positioned adjacent to, and extending a first distance over, the recessed pocket and located on a side of the recessed pocket closest to the front face; and at least one outer retention lug positioned adjacent to, and extending a second distance over, the recessed pocket and located on a side of the recessed pocket opposite from the inner retention lug; and a heat pipe disposed within the recessed pocket and secured therein by the inner and outer retentions lugs, the heat pipe configured to reduce and/or eliminate formation of condensation around the front face of the liner, wherein the inner retention lug is arranged on the flange in a staggered formation with respect to the outer retention lug, and wherein the inner retention lug has a first length spanning between a first forward end and a first rearward end, the outer retention lug has a second length spanning between a second forward end and a second rearward end, and the staggered formation is defined by the inner and outer retention lugs being positioned about the recessed pocket such that the first forward end of the inner retention lug is disposed adjacent the second rearward end of the outer retention lug, without said inner and outer retention lugs overlapping.

2. The refrigerator of claim 1, further comprising:

a first partition that separates the compartment into a fresh food section and a freezer section, wherein the heat pipe is only disposed within a portion of the recessed pocket that is formed into the flange that extends outwards from the front face only about the freezer section; and a second partition that separates the freezer section into a first zone and a second zone.

3. The refrigerator of claim 2, wherein the heat pipe is a condenser tube of an evaporative cooling system, the condenser tube having first and second ends, wherein the first end of the condenser tube is connected to a discharge port of said evaporative cooling system and wherein the second end of the condenser tube is connected to an inlet port of said evaporative cooling system.

4. The refrigerator of claim 3, wherein the front face of the freezer section comprises a first side segment, a second side segment, and a bottom segment, wherein the first and second side segments are parallel and are both perpendicular to the bottom segment, and wherein the recessed pocket is formed into the flange extending outwards from the first side segment, the second side segment, and the bottom segment.

5. The refrigerator of claim 4, wherein the condenser tube comprises a first portion extending vertically along the first side segment of the front face, a second portion extending horizontally along the bottom segment of the front face, a third portion extending vertically along the second side segment of the front face between the bottom segment of the front face and the second partition, a first loop portion extending horizontally along the second partition between the first and second side segments of the front face, a fourth portion extending vertically along the second side segment of the front face between the second partition and the first partition, and a second loop portion extending horizontally along the first partition between the first and second side segments of the front face.

6. The refrigerator of claim 5, wherein a plurality of inner retention lugs are equally spaced and disposed along the first and second side segments and the bottom segment of the front face, and wherein a plurality of outer retention lugs are equally spaced and disposed along the first and second side segments and the bottom segment of the front face.

7. The refrigerator of claim 1, wherein the liner, front face, flange, recessed pocket, and inner and outer retention lugs are all formed integral into a single piece.

8. The refrigerator of claim 1, wherein the heat pipe is secured within the recessed pocket only by the inner and outer retention lugs.

9. The refrigerator of claim 1, wherein the flange is configured such that the inner and outer retention lugs secure the heat pipe within the recessed pocket such that the heat pipe does not protrude beyond an imaginary plane upon which the front face lies.

10. The refrigerator of claim 1, wherein the flange is configured such that the inner and outer retention lugs secure the heat pipe within the recessed pocket such that the inner and outer retention lugs do not protrude beyond an imaginary plane upon which the front face lies.

* * * * *